US005892188A

United States Patent [19]

Hayashi et al.

[11] Patent Number: 5,892,188

[45] Date of Patent: Apr. 6, 1999

[54] POROUS FERRITE WAVE ABSORBER

[75] Inventors: Toshikatsu Hayashi; Hiroshi Kawamoto, both of Kumagaya, Japan

[73] Assignee: Kabushiki Kaisha Riken, Tokyo, Japan

[21] Appl. No.: 685,565

[22] Filed: Jul. 24, 1996

[51] Int. Cl.[6] ..... E04B 1/82; H01Q 17/00

[52] U.S. Cl. ..... 181/295; 342/4

[58] Field of Search ..... 181/294, 295; 342/1, 2, 3, 4

[56] References Cited

FOREIGN PATENT DOCUMENTS

| | | |
|---|---|---|
| 55-52300 A | 4/1980 | Japan . |
| 62-132783 A | 6/1987 | Japan . |
| 6275983 | 9/1994 | Japan . |
| 7302991 | 11/1995 | Japan . |
| 7302992 | 11/1995 | Japan . |
| 7302993 | 11/1995 | Japan . |
| 7302994 | 11/1995 | Japan . |
| 8130388 | 5/1996 | Japan . |
| 8130389 | 5/1996 | Japan . |

*Primary Examiner*—Khanh Dang
*Attorney, Agent, or Firm*—Kubovcik & Kubovick

[57] ABSTRACT

A wave absorber is provided which has a wave absorption characteristic of 20 dB in a frequency band of 1 GHz to 20 GHz, is nonflammable, compact and lightweight, and has excellent durability. A porous ferrite is produced as the base material for which is an Ni—Zn type ferrite which has an excellent wave absorption characteristic in the high frequency range, and this serves as a wave absorber formed in the shape of a pyramid or triangular prism.

4 Claims, 34 Drawing Sheets

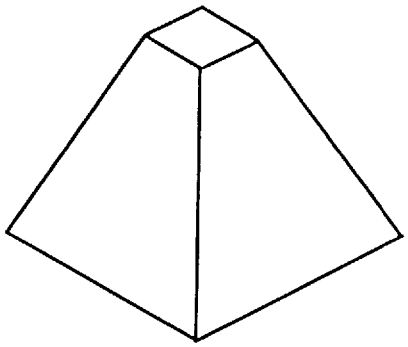
FIG. 24 (a)
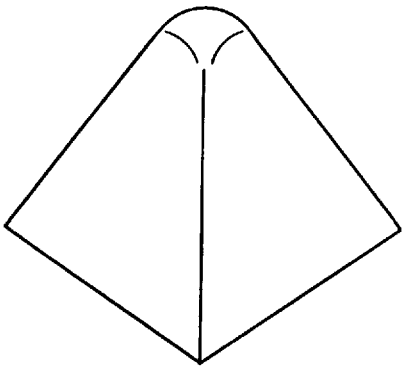
FIG. 24 (b)
FIG. 25
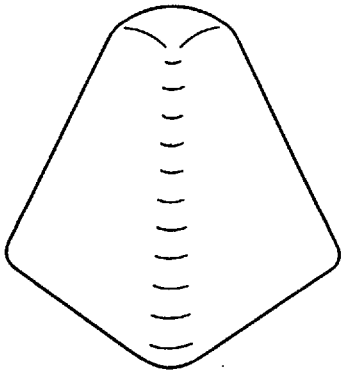

POROUS FERRITE WAVE ABSORBER

BACKGROUND OF THE INVENTION

The present invention relates to a wave absorber which has an excellent wave absorption characteristic in high frequency bands and is lightweight, compact and nonflammable.

A ferrite utilizing magnetic loss, one impregnating carbon or the like which has dielectric loss into a urethane, one forming these into a pyramid shape or triangular prism shape (hereafter referred to as a "carbon impregnation type"), and the like have been produced as wave absorbers. A wave absorber wall formed by aligning wave absorbers without gaps in a reflective plane surface has been applied in darkrooms where there is to be no refection of radio waves.

The above carbon impregnation type, because the urethane is formed in a pyramid shape or triangular prism shape, has the problems of its tip portion deforming over time, being easily flammable, etc. Although coating with a flame resistant can be performed to increase flame resistance, replacement is necessary every few years over which changes over time are large.

Incidentally, although a wave absorber normally requires a wave absorption factor of 20 dB or more as its wave absorption characteristic, in the case of a carbon impregnation type only, the wave absorption characteristic has such problems as being low in low frequency bands (30 MHz to 50 MHz), leading to the wave absorber having a thickness of 1 m or more, etc. In the case of a ferrite tile having a thickness of 6 to 8 mm, the band width at which it exhibits an absorption of 20 dB or more is a maximum of 30 MHz to 600 MHz or thereabouts, while in the case of a combination of a ferrite and a carbon impregnation type, there is the problem that the thickness is 60 cm or more.

Dark rooms are classified as anechoic rooms for measuring electromagnetic noise emitted from electronic machinery and fully anechoic rooms for testing the noise resistance of electronic machinery etc. In noise resistance tests, because a strong electric field is used, there is the problem of the wave absorber igniting, therefore it is extremely important that the wave absorber be nonflammable.

Also, as the thickness of the wave absorber increases, significant problems such as the effective area within the dark room or the like becoming narrower, the size of the construction becoming larger, and an increase in land allocation and construction costs are incurred.

Further, in recent years diversification of radio wave utilization has spread to the microwave range as typified by microwave ovens and portable wireless, and the necessity for a wave absorber and also a dark room which are effective even in the microwave range from 10 GHz to about 20 GHz as one countermeasure against radio wave pollution has greatly increased.

SUMMARY OF THE INVENTION

The present invention has as its object to provide a wave absorber which has a wave absorption characteristic of 20 dB in a frequency band of 1 GHz to 20 GHz, is nonflammable, compact and lightweight, and has excellent durability.

The present invention also has as its object to provide a wave absorber which has a wave absorption characteristic of 20 dB in a frequency band of 1 GHz to 30 GHz, is nonflammable, compact and lightweight, and has excellent durability.

Further, the present invention has as an additional object to provide a low cost wave absorber which resolves the disadvantages of the prior art wave absorber, is nonflammable, has an excellent wave absorption characteristic, is compact and lightweight, and has excellent durability.

The present invention has as still another object to provide a wave absorber which resolves the disadvantages of the prior art wave absorber, is nonflammable, has an excellent wave absorption characteristic, is compact and lightweight, and has excellent durability and workability.

Generally, the complex relative magnetic permeability $\mu r=\mu'-j\mu$ (or the loss angle tan $\partial=\mu''/\mu'$) and the complex relative dielectric permeability $Er=E'-jE''$ (or the loss angle tan $\partial=E''/E'$) are the basic characteristics for base materials at high frequencies. If the complex relative magnetic permeability and complex relative dielectric constant are known, the reflectivity of the base material (the ratio reflected at the surface of the base material when the incident waves are perpendicular to the base material) can be obtained and considered the absorption characteristic of the base material.

Porous ferrite, in order to utilize the magnetic characteristic of the ferrite to improve the absorption effect, has a wave absorption characteristic which depends on the frequency characteristic of the relative magnetic permeability of the ferrite which is the base material. Consequently, in obtaining an absorption effect in a frequency band of microwaves or above, this is improved to the extent that the peak loss of the relative magnetic permeability is a high frequency. Also, by rendering the ferrite porous the relative dielectric constant can be lowered and the wave absorption characteristic at high frequencies improved.

The present invention, by forming a wave absorber from porous ferrite with high frequency characteristic Ni—Zn ferrite as the base material, improves the wave absorption characteristic at high frequencies. Further, by forming the wave absorber in a pyramid shape or triangular prism shape, the wave absorption characteristic at high frequencies is improved even further and miniaturization and weight reduction is possible.

The frequency characteristic of the relative magnetic permeability of the Ni—Zn ferrite changes due to composition and, as shown in FIG. 1, is such a high frequency characteristic that the Ni ratio in the composition is high. Consequently, by making the base material a high Ni ratio composition, the wave absorption characteristic of the porous ferrite in the high frequency range can be improved. Accordingly, by making the base material of the porous ferrite forming the wave absorber $Ni_XZn_{1-X}Fe_2O_4$ (X=0.36 to 1.00), the wave absorption effect in the high frequency range can be increased. Although the wave absorption characteristic in the lower frequency range is good where the Ni ratio is 0.36 or less, this characteristic is bad in the high frequency range.

The porous ferrite formed by these materials can produce a wave absorber whose 20 dB or more absorption range is 1 GHz to 20 GHz and thickness is 100 mm or less and which is excellent in terms of miniaturization.

If the porosity of the porous ferrite is 30% or less it will be too heavy, and porous ferrite cannot be molded at 90% or more. Therefore, if the porosity is 30% to 90% a lightweight and moldable porous ferrite can be obtained.

Since the wave absorber of the present invention is a sintering material of ferrite which is porous, its fire resistance is greater than normal, it has sufficient strength and its deformation over time is slight.

Also, where the porous ferrite according to the present invention is combined with a ferrite tile, it exhibits an absorption characteristic of 20 dB and more in the 30 MHz to 20 GHz frequency band and is utilizable as a dark room wave absorber applicable over a wide frequency range.

BRIEF DESCRIPTION OF THE DRAWINGS

These and other features, aspects and advantages of the present invention will become better understood with reference to the following description, appended claims and accompanying drawings, wherein:

Figure 19:
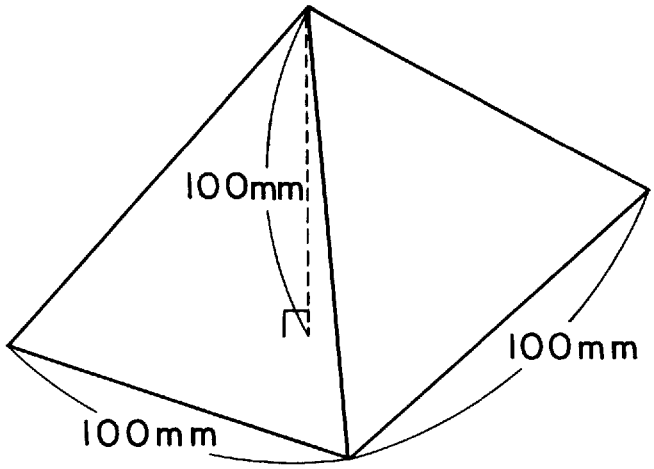
Figure 20A:
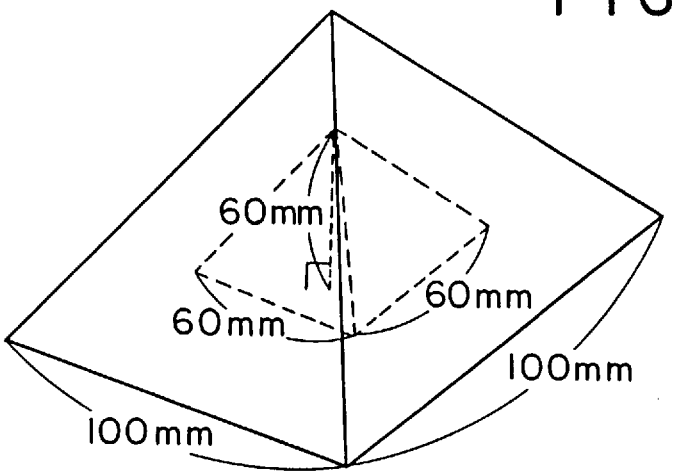
Figure 20B:
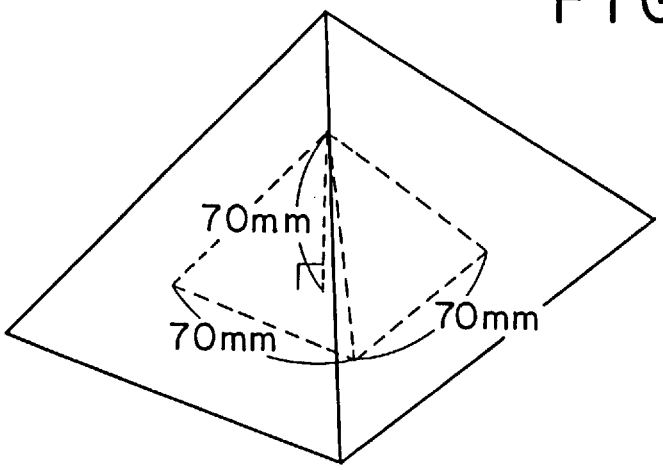
Figure 20C:
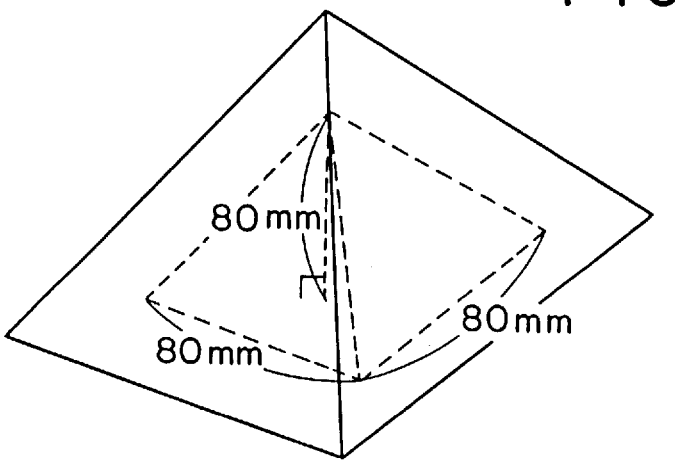
Figure 21:
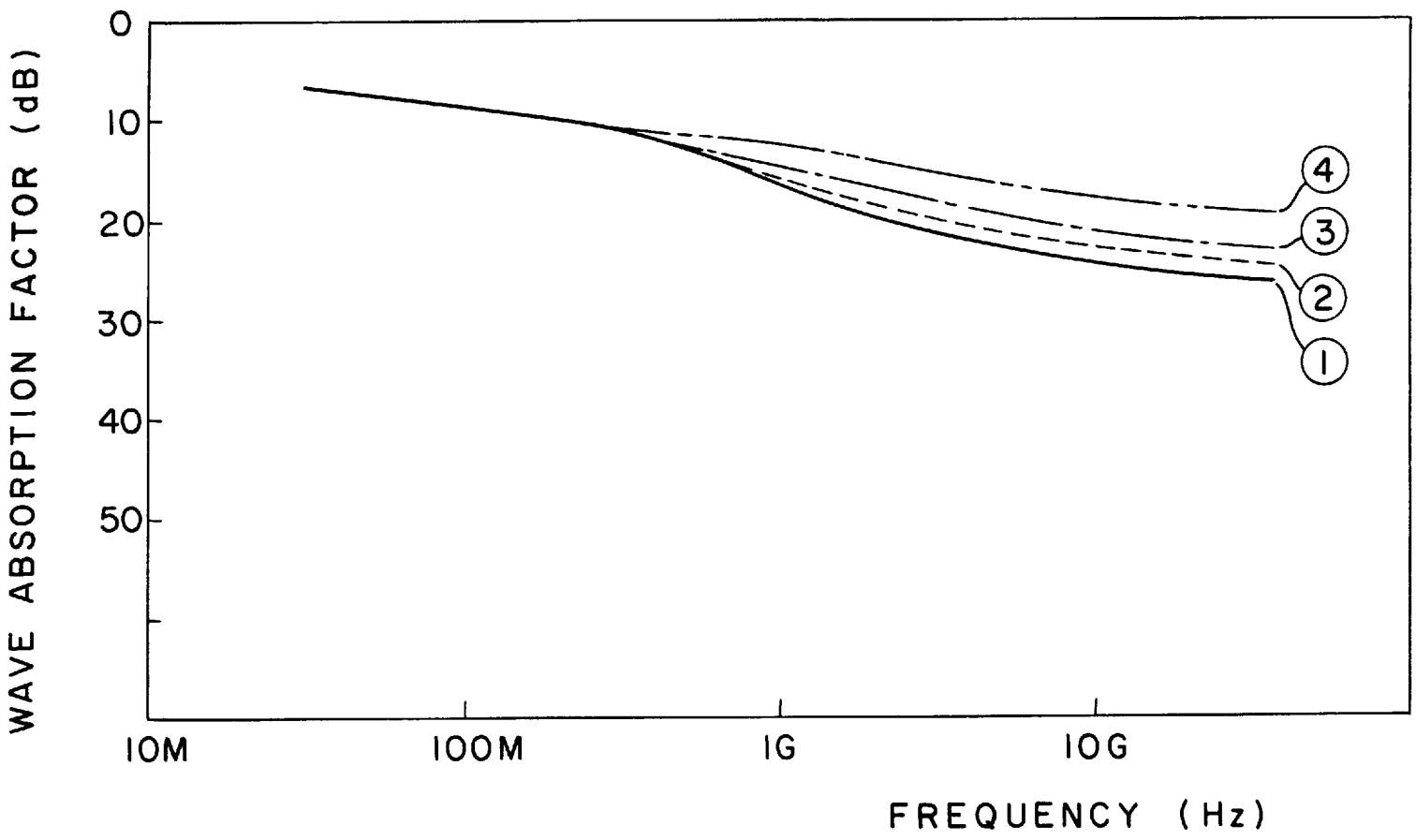
Figure 22:
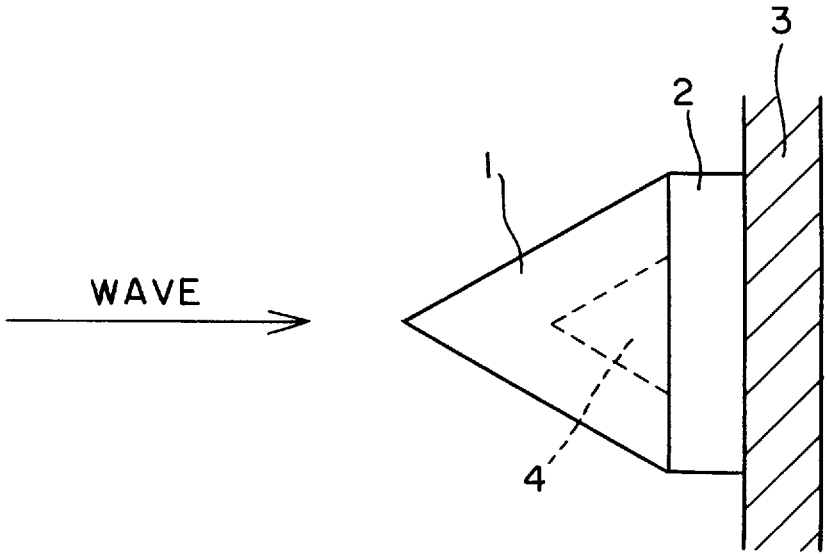
Figure 23:
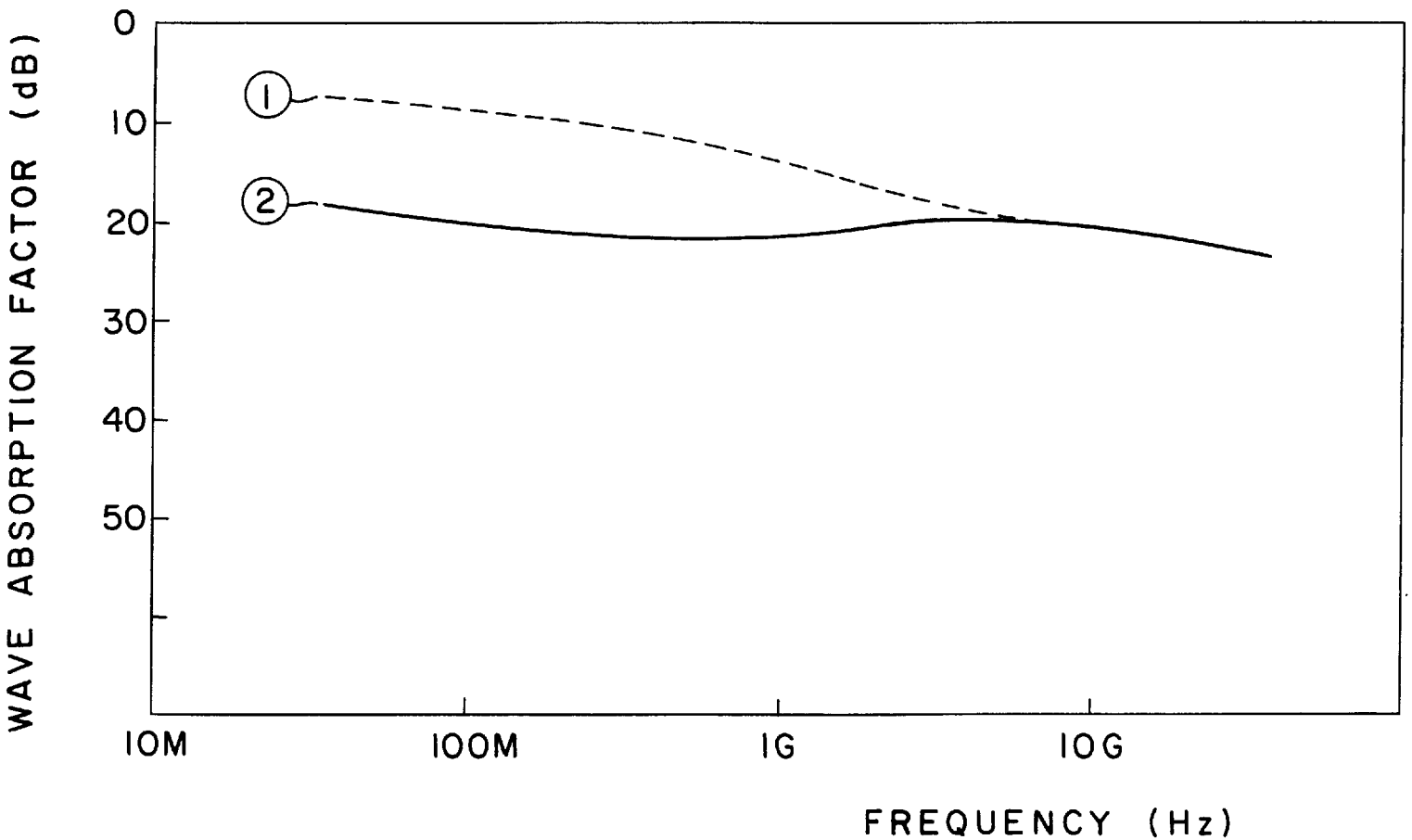
Figure 26:
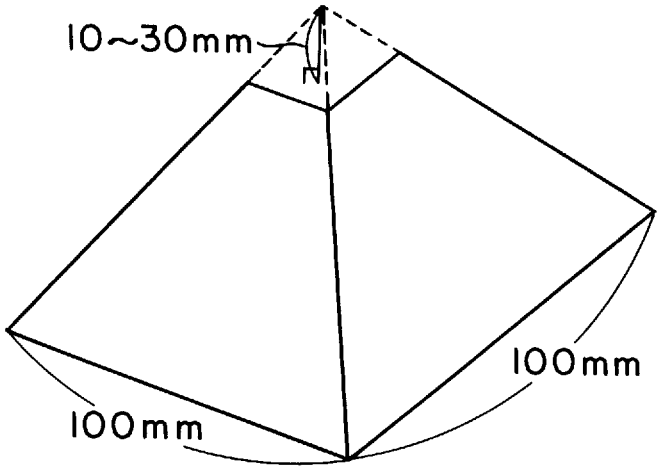
Figure 27:
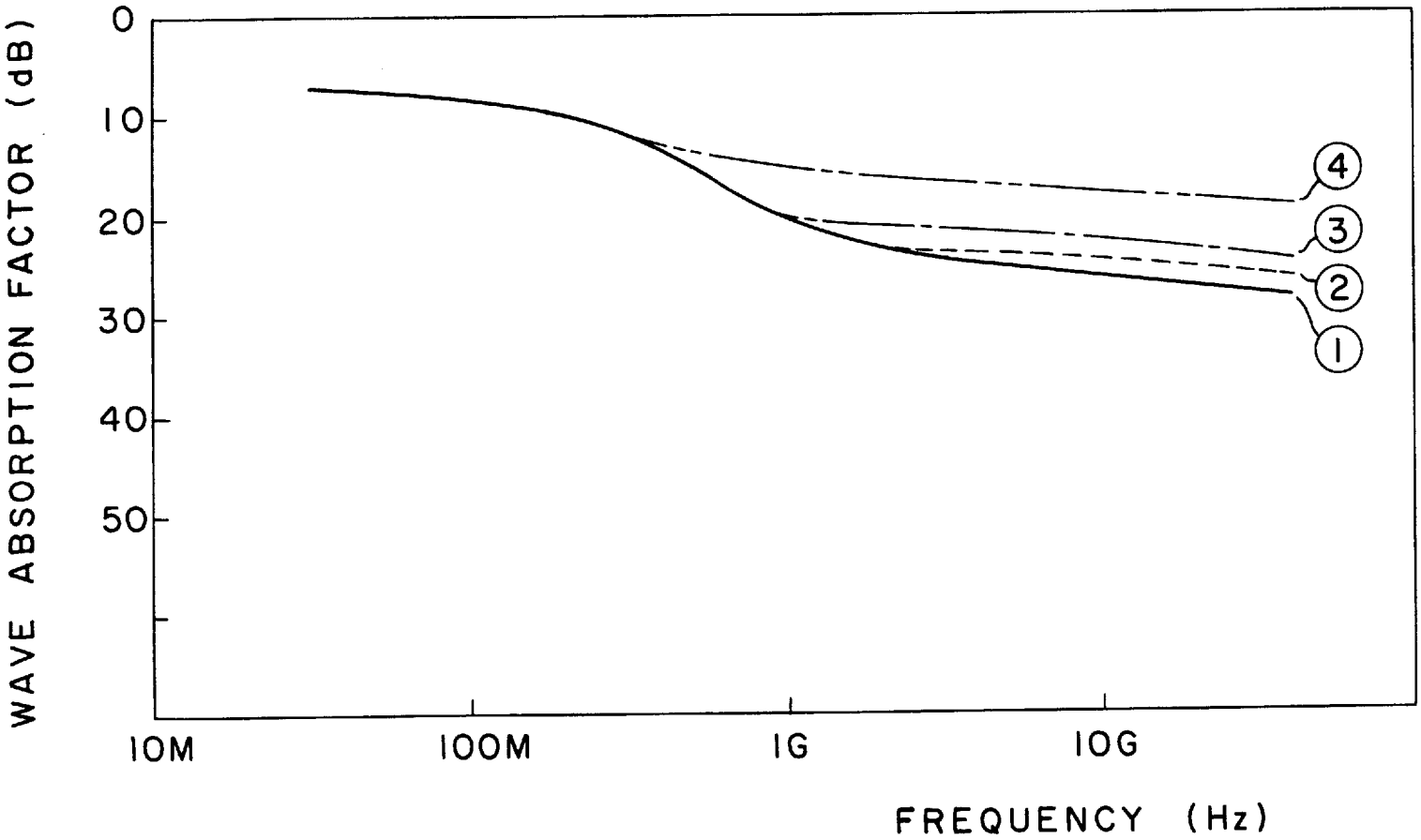
Figure 28:
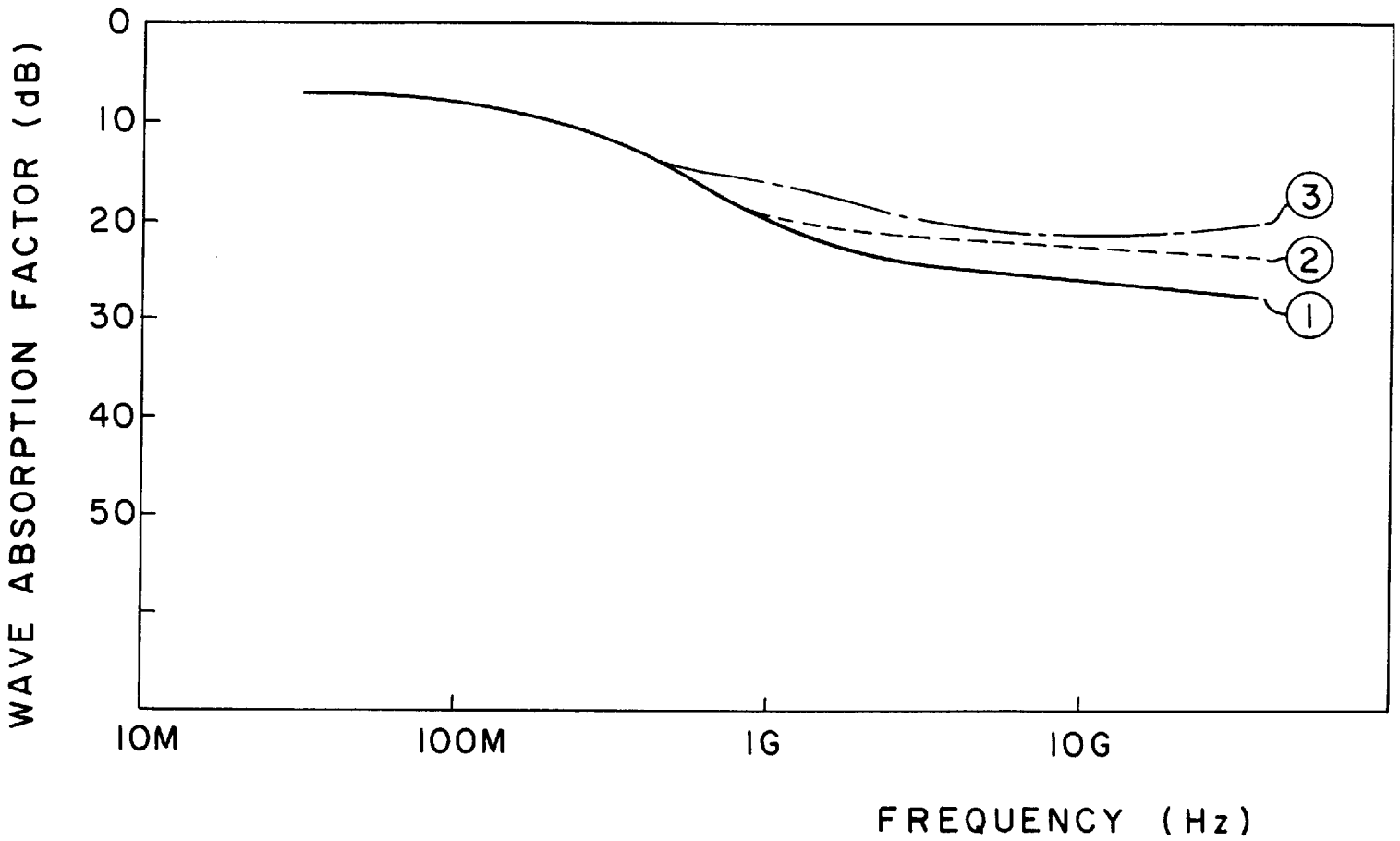
Figure 29:
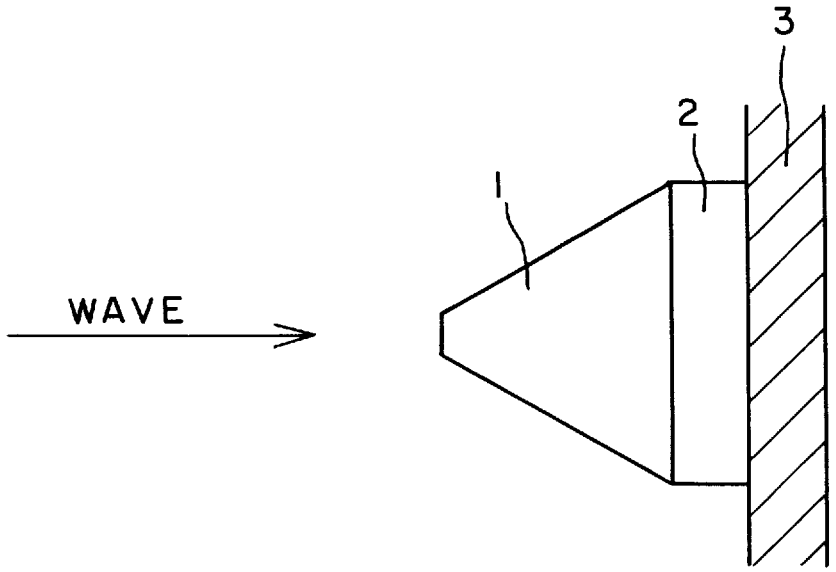
Figure 30:
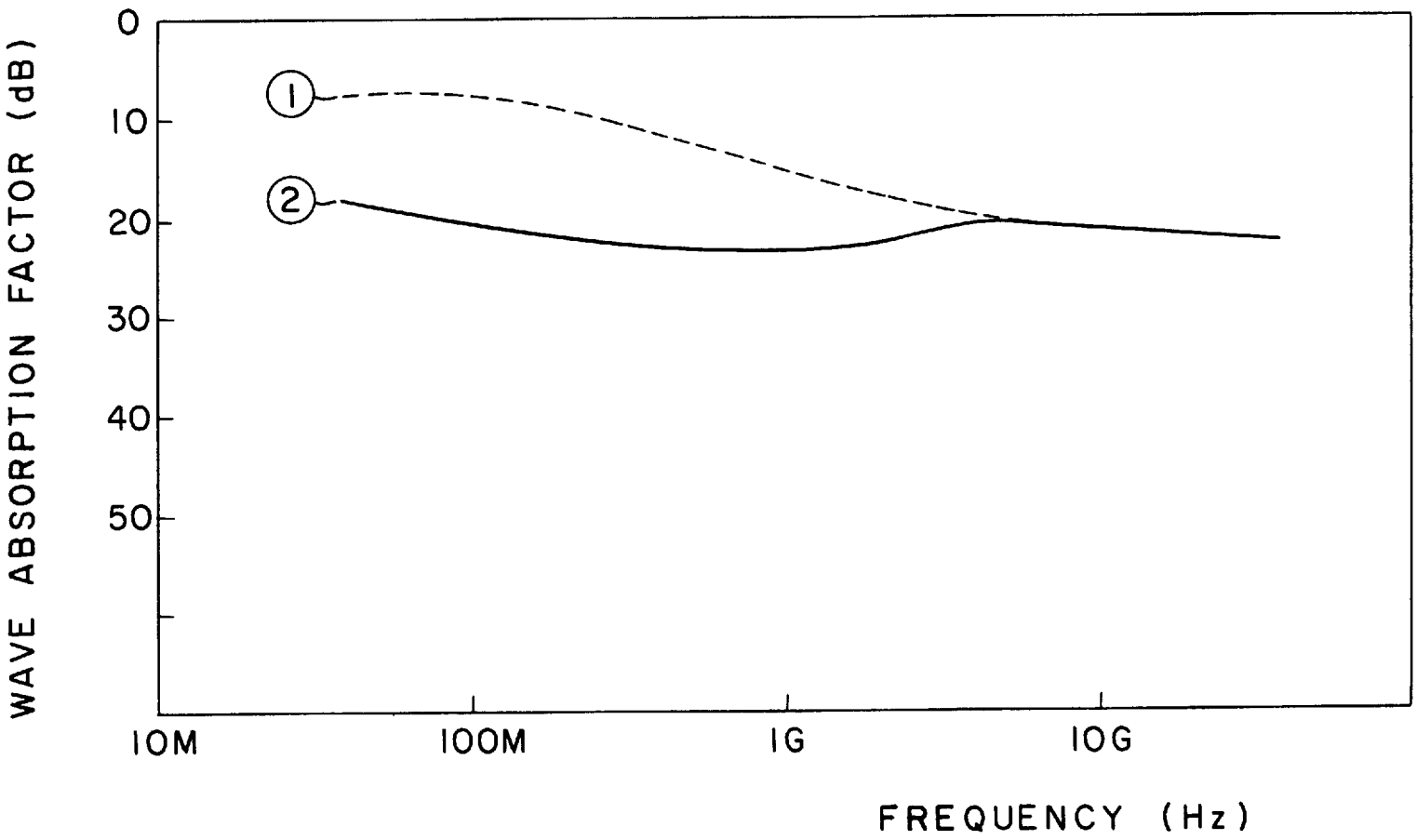
Figure 31A:
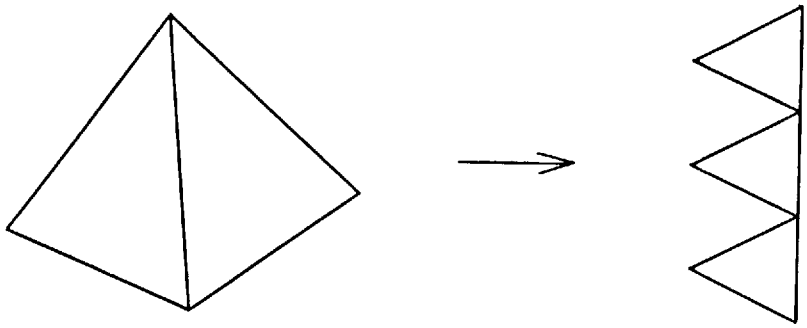
Figure 31B:
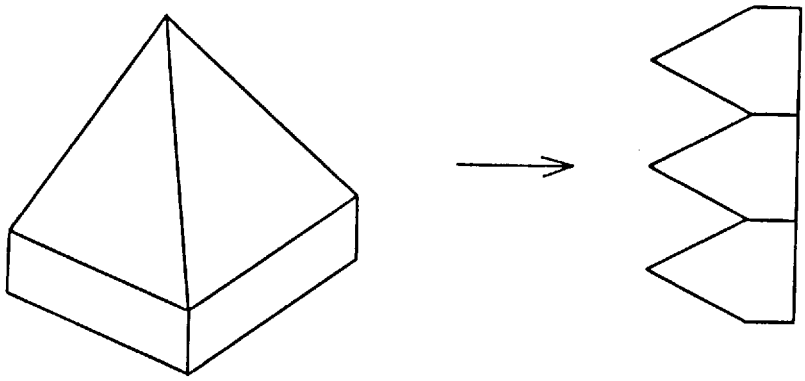
Figure 32:
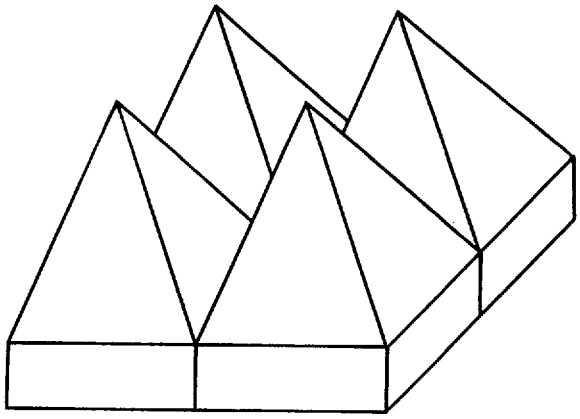
Figure 33:
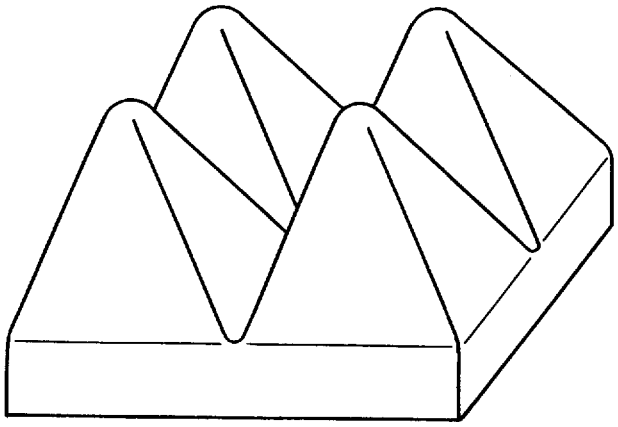
Figure 34:
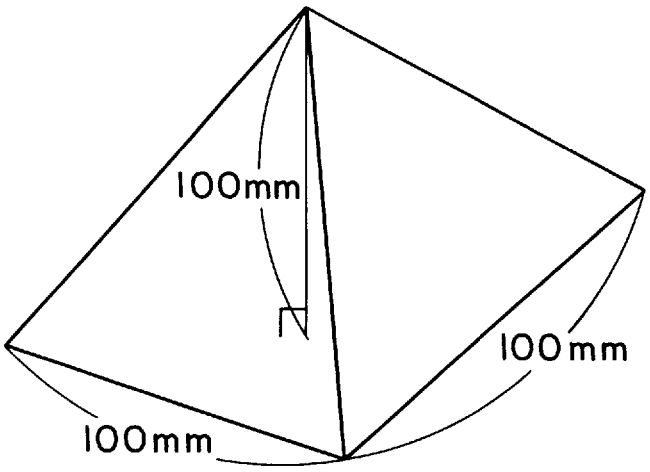
Figure 35A:
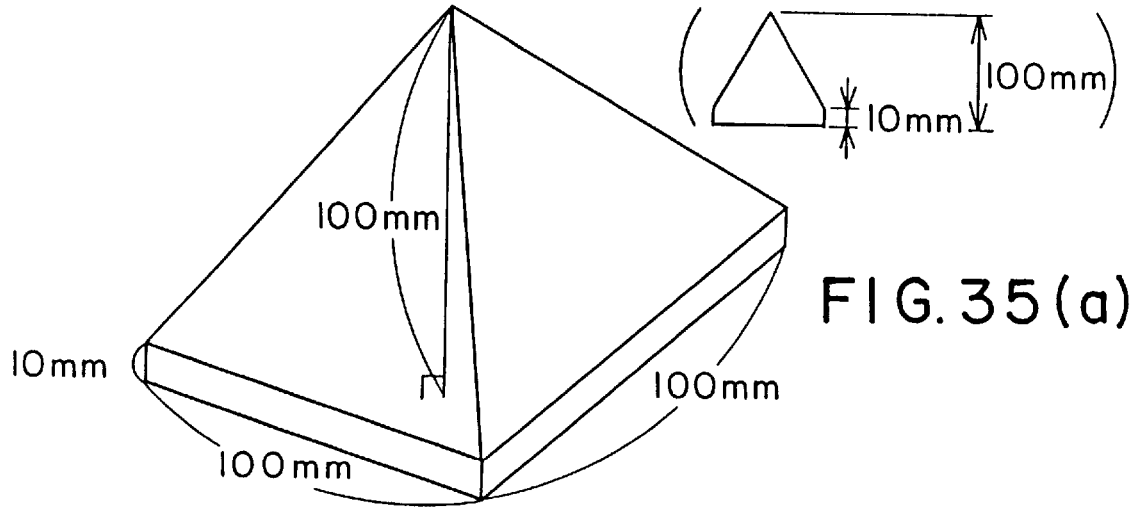
Figure 35B:
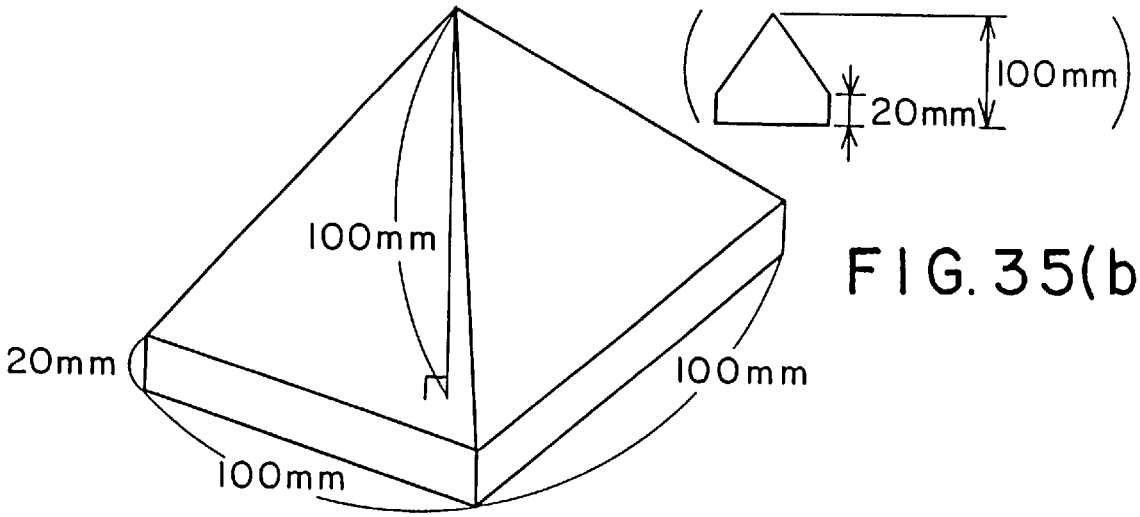
Figure 35C:
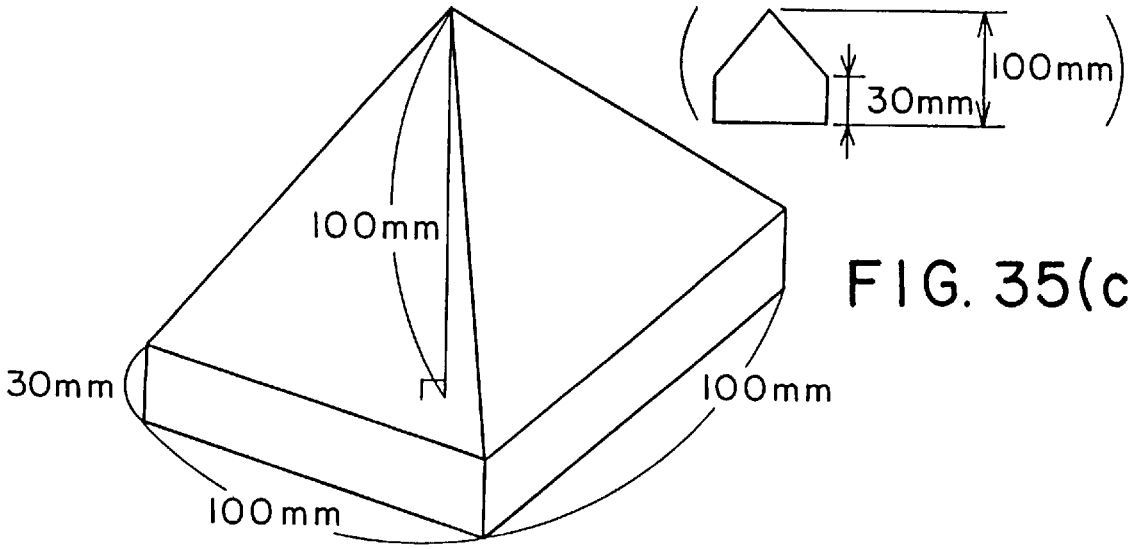
Figure 36:
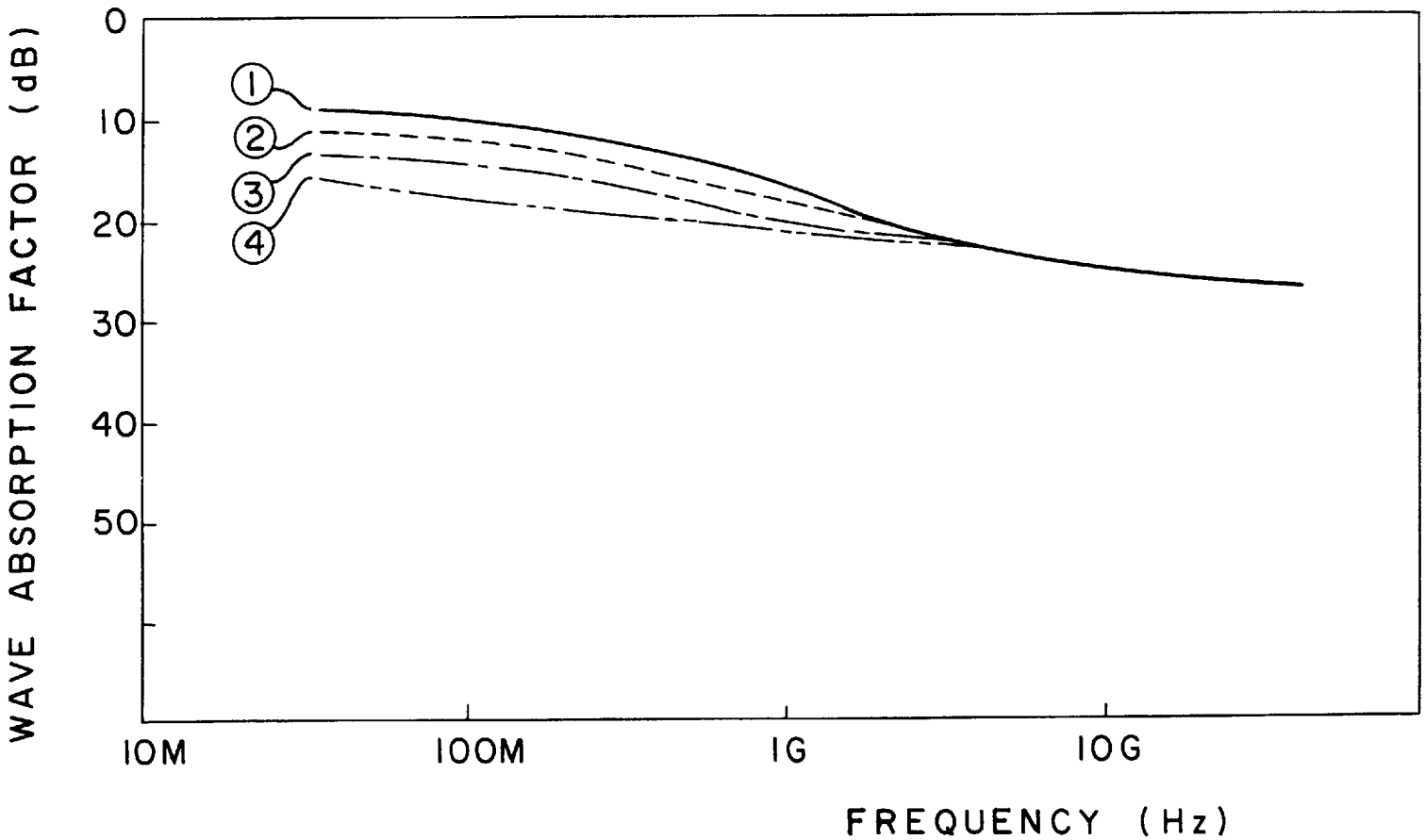
Figure 37:
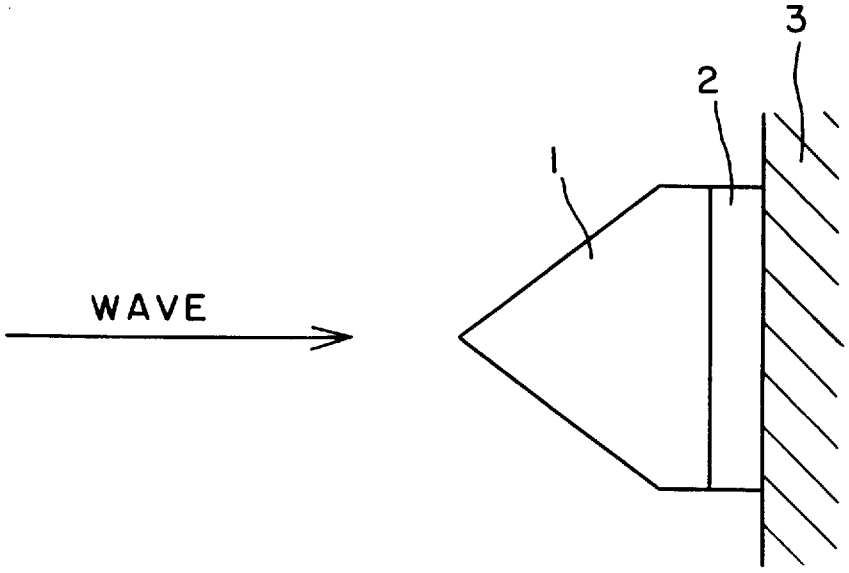
Figure 38:
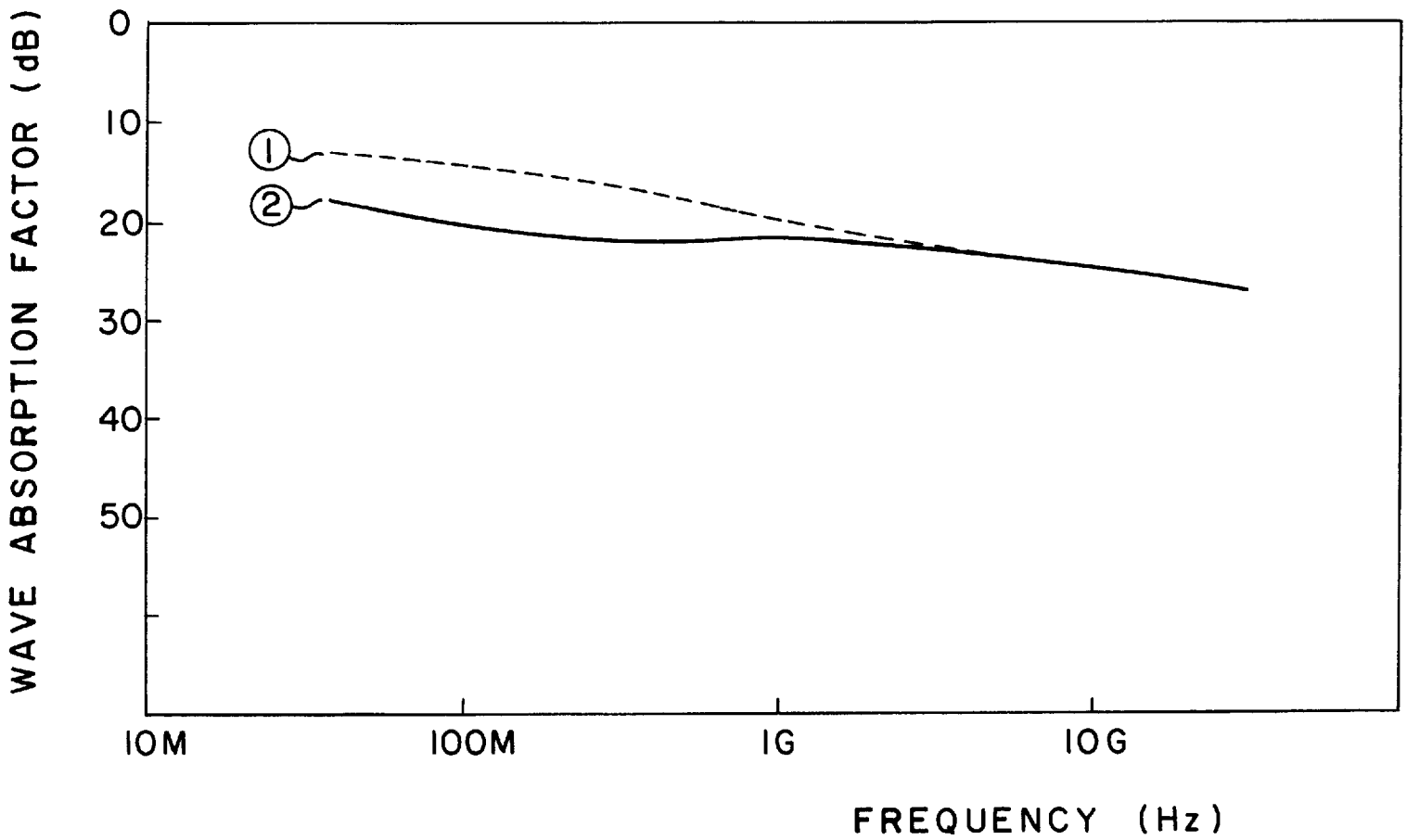

(1): pyramid shape, (2): rectangular parallelepiped shape, (3): semi-circular shape;

FIG. 19 shows the shape of a conventional porous ferrite pyramid type used in the ninth embodiment;

FIGS. 20(a)–20(c) show the shape of a hollow porous ferrite pyramid type used in the eighth embodiment;

FIG. 21 shows the wave absorption characteristics of the wave absorber obtained by the eighth embodiment:

(1) absorption characteristics of conventional type, (2) absorption characteristics of a porous pyramid type having a hollow pyramid shape of lower surface dimensions 60 mm×60 mm and height 60 mm, (3) absorption characteristics of a porous pyramid type having a hollow pyramid shape of lower surface dimensions 70 mm×70 mm and height 70 mm, (4) absorption characteristics of a porous pyramid type having a hollow pyramid shape of lower surface dimensions 80 mm×80 mm and height 80 mm;

FIG. 22 shows the structure of the wave absorber used in the ninth embodiment;

FIG. 23 shows the wave absorption characteristics of the wave absorber obtained by the ninth embodiment:

(1) absorption characteristics of a pyramid type porous ferrite body having a hollow pyramid shape of lower surface dimensions 70 mm×70 mm and height 70 mm, (2) absorption characteristics of a pyramid type porous ferrite with ferrite tile having a hollow pyramid shape of lower surface dimensions 70 mm×70 mm and height 70 mm;

FIGS. 24(a) and 24(b) show the tip portion shape of a pyramid type porous ferrite as illustrated by another example of the present invention;

FIG. 25 shows a shape wherein each edge portion of the pyramid type porous ferrite has been rounded;

FIG. 26 shows the shape of a porous ferrite used in the tenth embodiment wherein the tip portion of the pyramid shape has been trimmed to a plane surface;

FIG. 27 shows the wave absorption characteristics of the wave absorber obtained by the tenth embodiment:

(1) absorption characteristics of conventional type, (2) absorption characteristics where tip portion has been trimmed to 10 mm, (3) absorption characteristics where tip portion has been trimmed to 20 mm, (4) absorption characteristics where tip portion has been trimmed to 30 mm;

FIG. 28 shows the wave absorption characteristics of the wave absorber obtained by the eleventh embodiment:

(1) absorption characteristics of conventional type (height 100 mm), (2) absorption characteristics where trimmed to 20 mm, (3) absorption characteristics of conventional type (height 80 mm);

FIG. 29 shows the structure of the wave absorber used in the twelfth embodiment;

FIG. 30 shows the wave absorption characteristics of the wave absorber obtained by the twelfth embodiment:

(1) absorption characteristics of porous ferrite body where trimmed to 20 mm, (2) absorption characteristics of porous ferrite body with ferrite tile where trimmed to 20 mm;

FIG. 31(a) and 31(b) show the shape of a porous ferrite:

(1) pyramid type (conventional type), (2) porous ferrite shown in first embodiment of the present invention;

FIG. 32 shows a panel (individual combination) of porous ferrite according to the present invention;

FIG. 33 shows a panel (integral type) of porous ferrite according to the present invention;

FIG. 34 shows the shape of the conventional porous ferrite used in the thirteenth embodiment;

FIG. 35(a)–35(c) show the shape of the porous ferrite according to the present invention and used in the thirteenth embodiment (pyramid type porous ferrite of the present invention with lower portion of rectangular parallelepiped shape):

Height from lower surface:

(1) 10 mm, (2) 20 mm, (3) 30 mm;

FIG. 36 shows the wave absorption characteristics of the wave absorber obtained by the thirteenth embodiment:

(1) absorption characteristics of conventional type, (2) absorption characteristics where height from lower surface of rectangular parallelepiped is 10 mm, (3) absorption characteristics where height from lower surface of rectangular parallelepiped is 20 mm, (4) absorption characteristics where height from lower surface of rectangular parallelepiped is 30 mm, FIG. 37 shows the structure of the wave absorber used in the fourteenth embodiment;

FIG. 38 shows the wave absorption characteristics of the wave absorber obtained by the fourteenth embodiment:

(1) absorption characteristics of a porous ferrite body whose height from the lower surface of a rectangular parallelepiped shape is 20 mm, (2) absorption characteristics of a porous ferrite body and ferrite tile whose height from the lower surface of a rectangular parallelepiped shape is 20 mm,

DETAILED DESCRIPTION OF THE INVENTION

Hereunder, the embodiments of the present invention will be described in details based on the enclosed drawings.

First Embodiment

Figure 1:
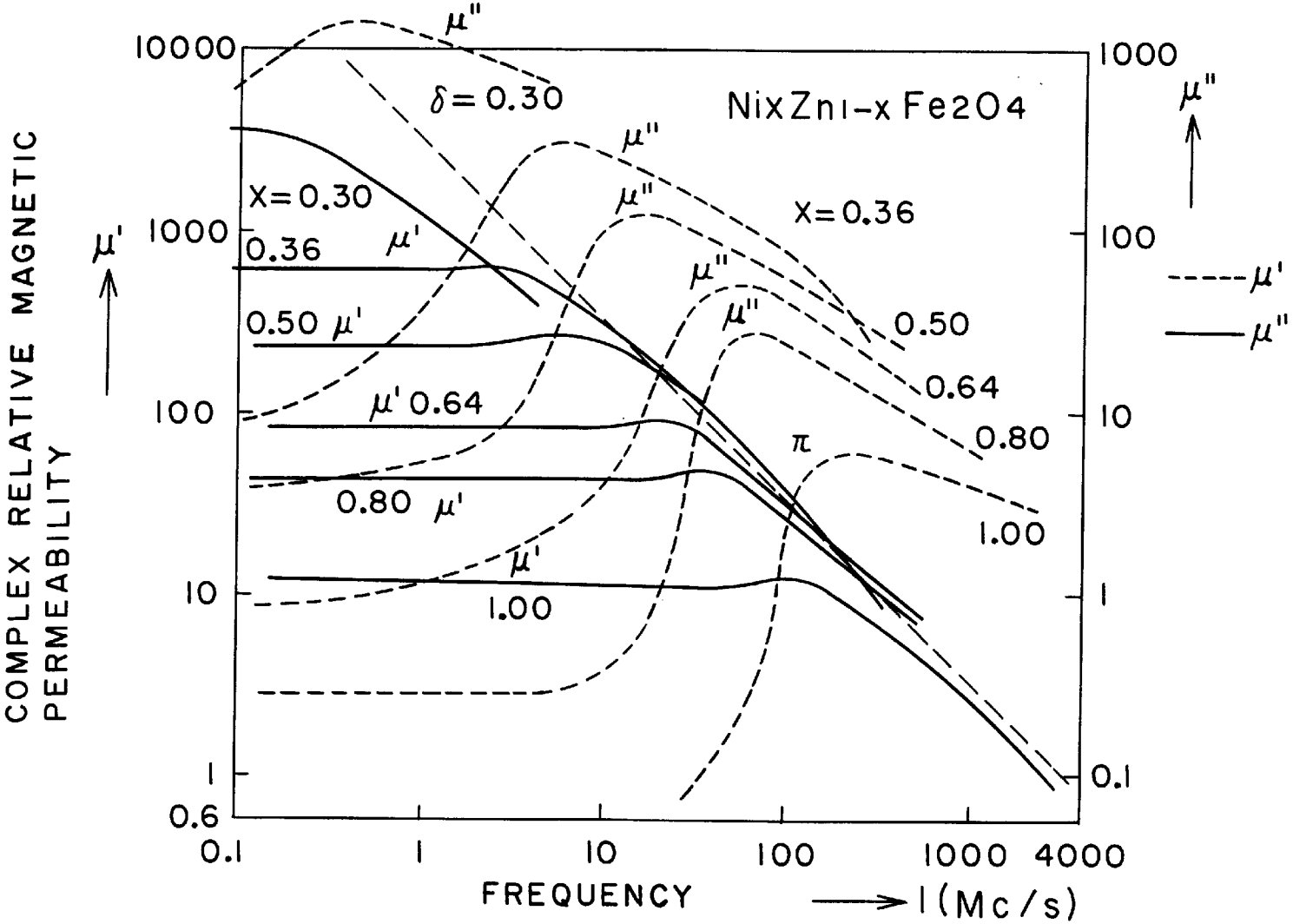
FIG. 1 is a graph showing the complex relative magnetic permeability frequency characteristics with respect to various Ni ratios in an Ni—Zn type ferrite.
Figure 2:
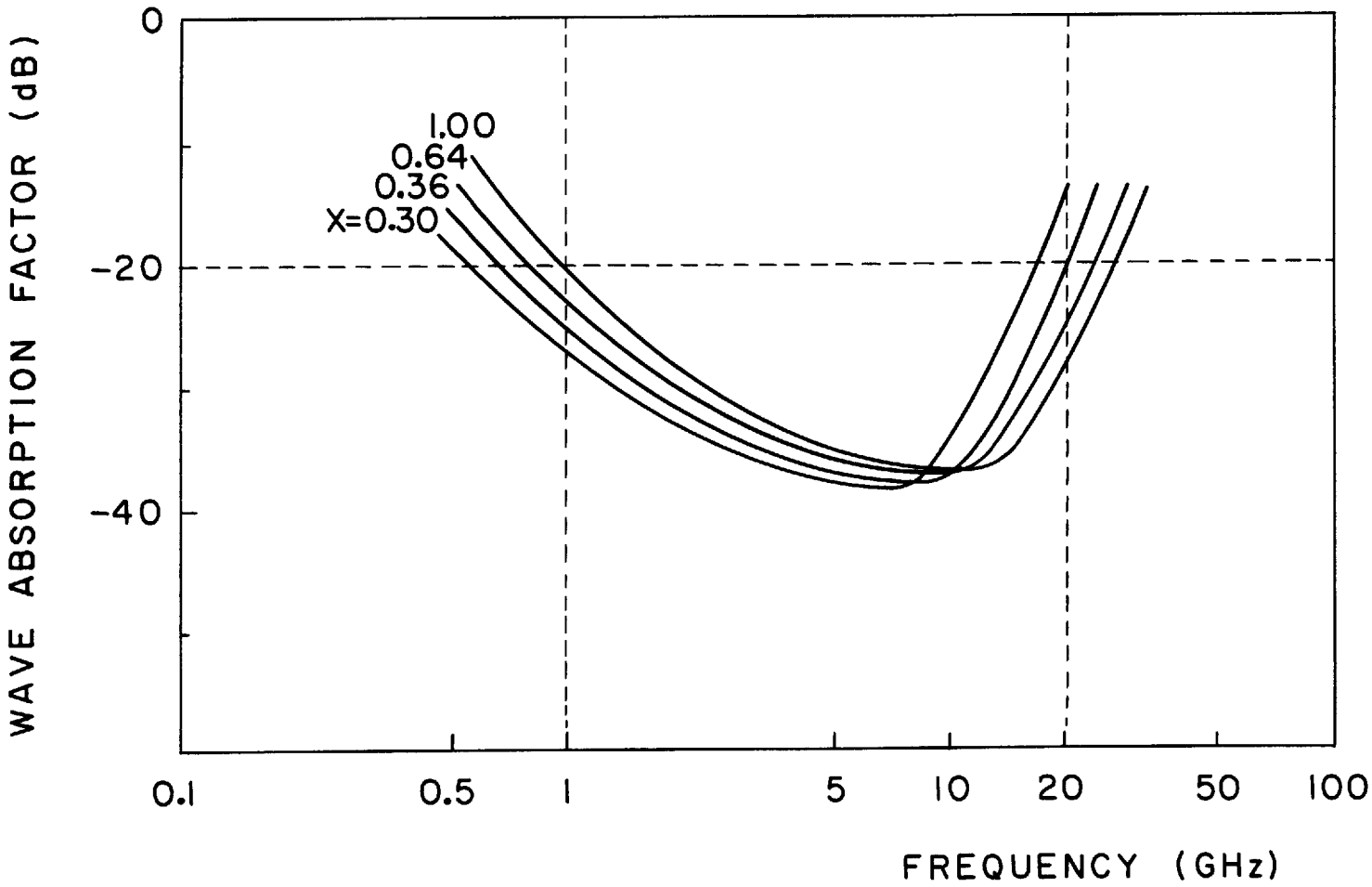
FIG. 2 is a graph showing wave absorption characteristics of each wave absorber of the first embodiment of the present invention.
Figure 3:
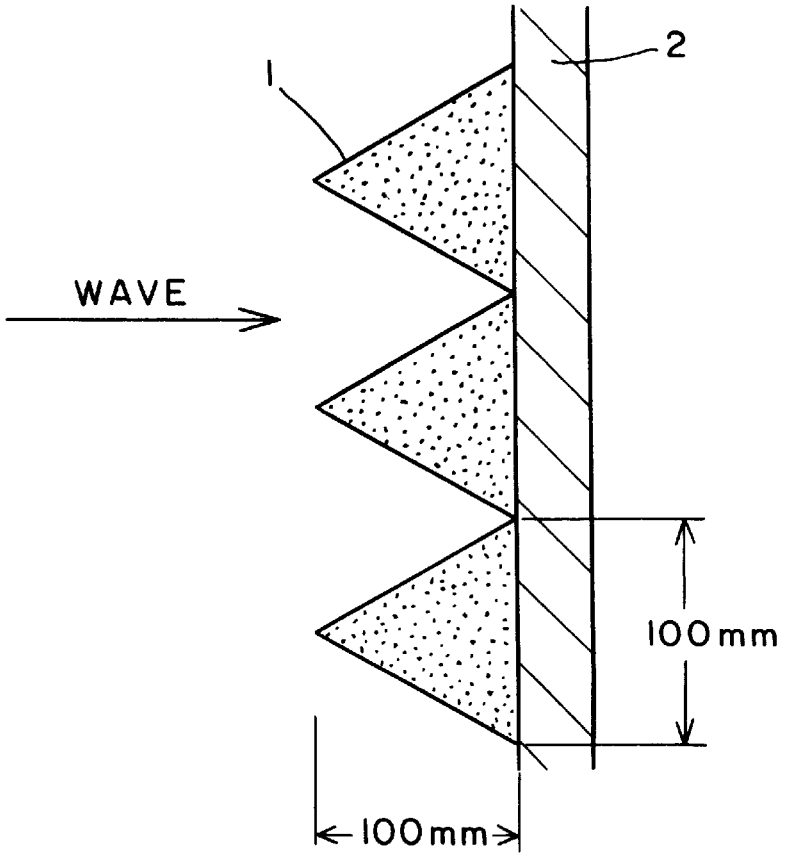
FIG. 3 is a cross section showing the structure of an embodiment of the present invention.

As explained previously in conjunction with FIG. 1, the frequency characteristic of the relative magnetic permeability of the Ni—Zn ferrite is such a high frequency characteristic that the Ni ratio in the composition is high. An Ni—Zn ferrite at differing Ni ratios is a high porosity material, at 60% porosity, serving as the base material, and as shown in FIG. 3, was formed into a wave absorber 1 having a pyramid shape the area of whose lower surface (base) was 100 mm×100 mm and whose height was 100 mm, this being attached without a gap therebetween to one surface of a reflection plate 2, then waves were made incident perpendicularly to the surface of the reflection plate 2 and the absorption factor thereof was measured. A graph of wave absorption characteristics based on these measurement results is shown in FIG. 2. In the figure is shown a graph of wave absorption characteristics in the four cases where the Ni ratio X is 0.30, 0.36, 0.64, and 1.00, the abscissa being the frequency and the ordinate being the wave absorption factor. As is clear from this graph, the absorption characteristic in high frequency bands improved where the Ni ratio in the composition was higher, the 20 dB absorption range was wide at 1 GHz to 20 GHz where the Ni ratio is X=0.36 and exhibited an excellent wave absorption characteristic. Note that where the Ni ratio was less than 0.36, although the wave absorption characteristic in the lower frequency range was good, this characteristic deteriorated in the high frequency range.

Second Embodiment

Figure 4:
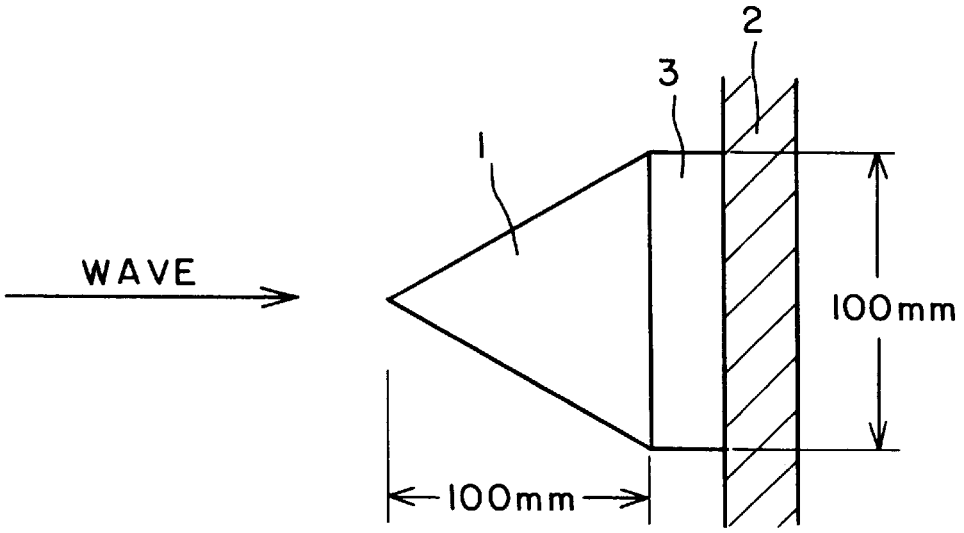
FIG. 4 is a cross section showing the structure of another embodiment of the present invention.
Figure 5:
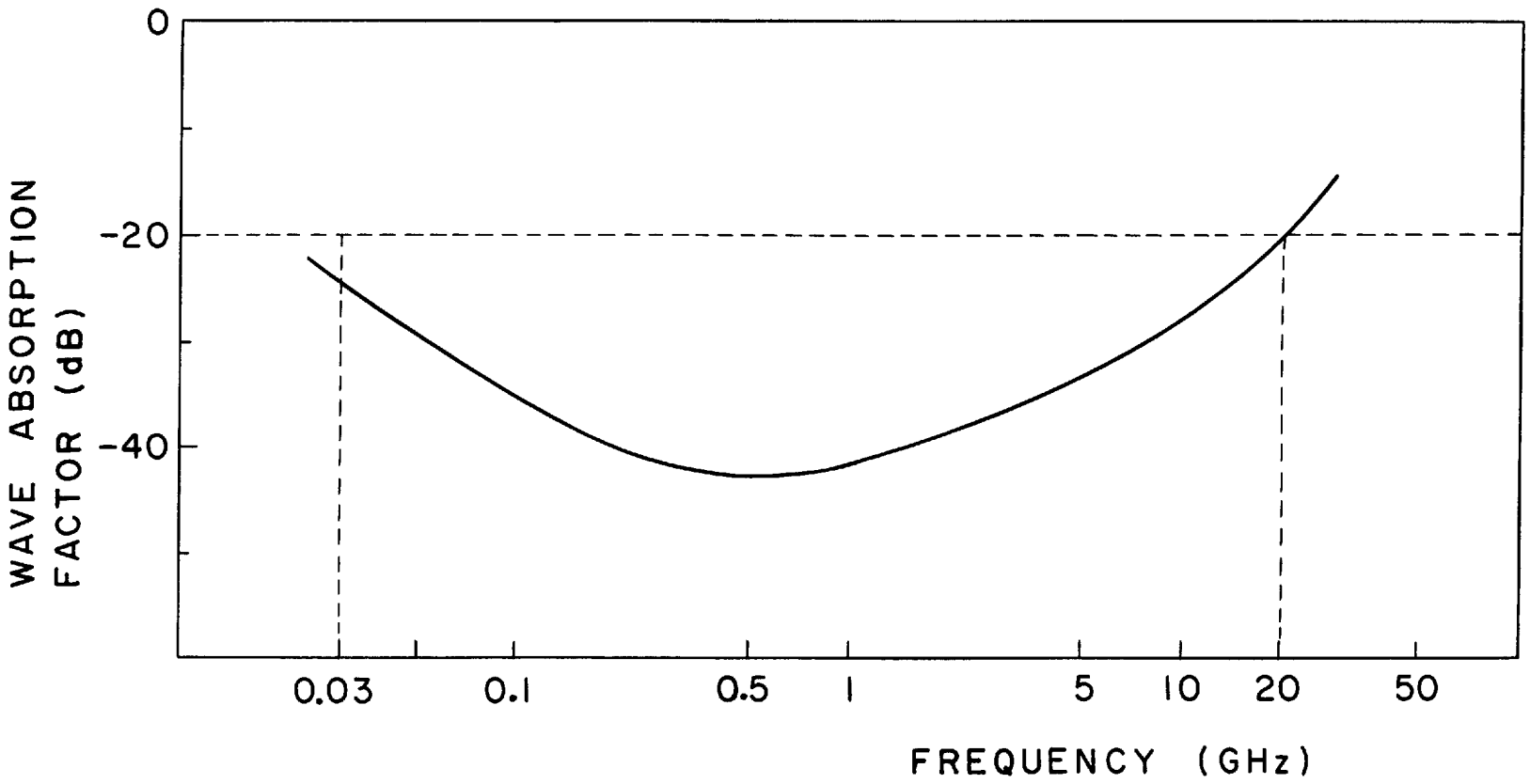
FIG. 5 is a graph showing wave absorption characteristics according to the structure of the embodiment shown in FIG. 4 of the present invention.

A pyramid shaped wave absorber 1 having the composition Ni ratio X=0.36 of the first embodiment as combined with a ferrite tile 3 as shown in FIG. 4 and attached to one surface of a reflection plate 2, then waves were made incident perpendicularly to the surface thereof and the wave absorption factor thereof was measured. The results are shown in FIG. 5. As becomes clear upon comparing the wave absorption characteristic graph of this figure and the wave absorption characteristic graph of X=0.36 shown in FIG. 2, by means of the ferrite tile, the absorption characteristic at low frequencies of 1 GHz or less was improved and the 20 dB absorption range broadened to 30 MHz to 20 GHz.

As explained above, according to the present invention, a wave absorber which has a wave absorption characteristic of 20 dB in a frequency band of 1 GHz to 20 GHz, is nonflammable, compact and lightweight, and has excellent durability can be achieved, and a dark room corresponding to high frequency bands can be economically constructed.

Third Embodiment

Figure 6:
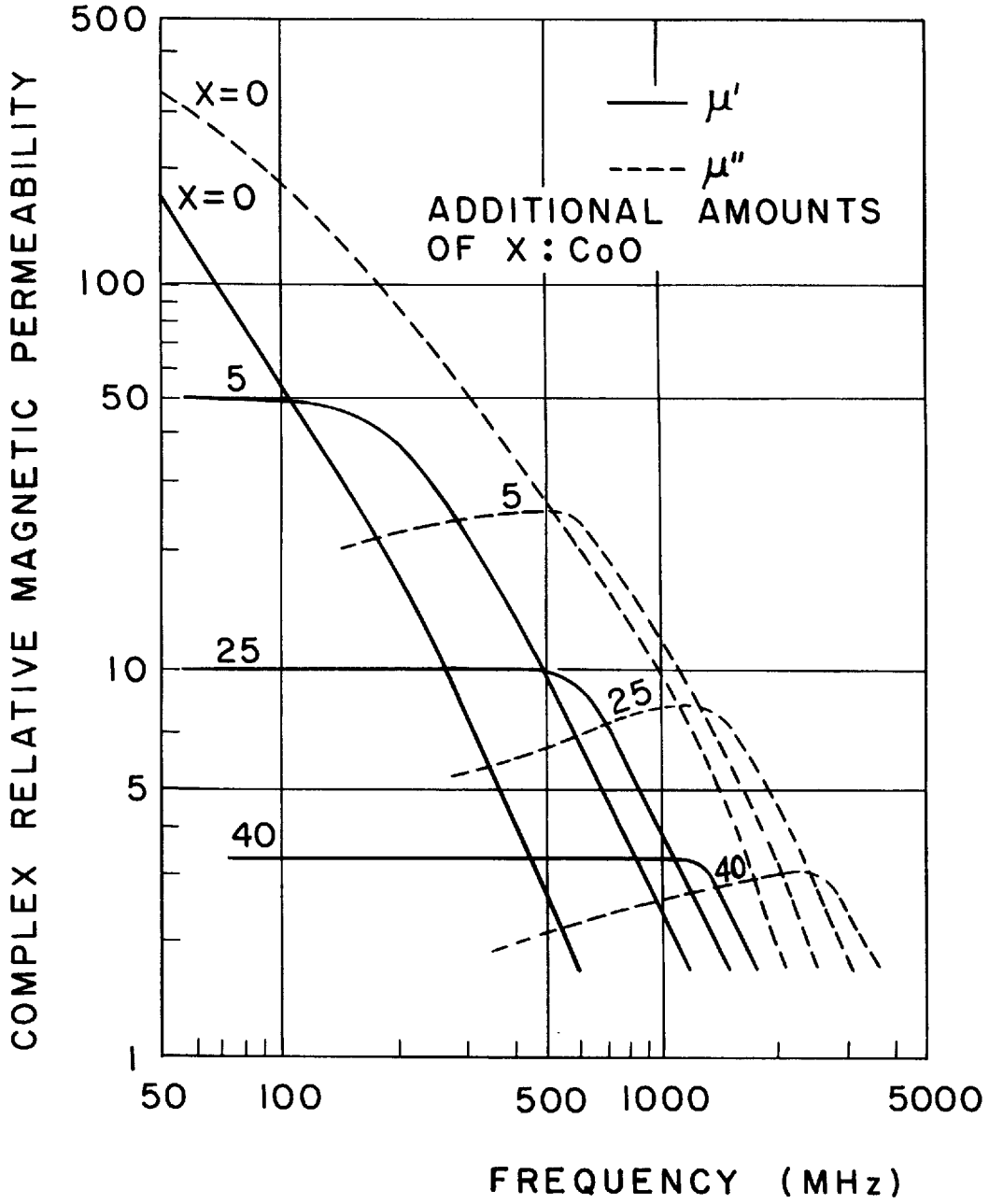
FIG. 6 is a graph showing the complex relative magnetic permeability frequency characteristics of an Ni—Zn type ferrite to which varying amounts of CoO have been added.

The frequency characteristics of the magnetic permeabilities of five types of ferrite in whose compositions CoO was added in the amounts of 0 to 40 weight percent to the Ni—Zn ferrite $Ni_{18}Zn_{32}Fe_2O_4$ (Ni ratio=0.36) are shown in FIG. 6. In this figure, it can be seen that the higher the added amount of CoO, the more the magnetic permeability peak shifted toward higher frequencies.

Figure 7:
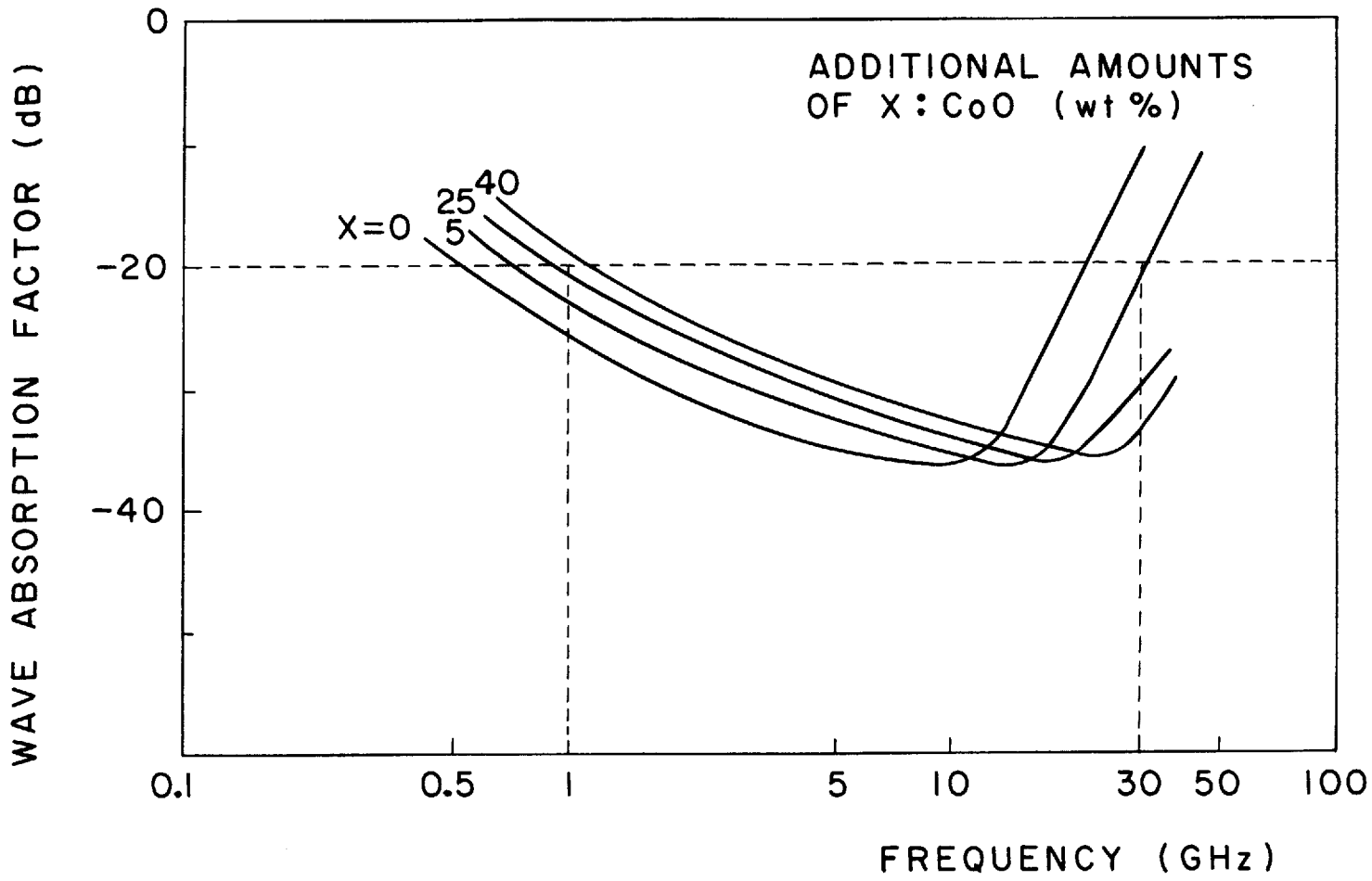
FIG. 7 is graph showing the wave absorption characteristics of an Ni—Zn type ferrite porous body to which varying amounts of CoO have been added.
Figure 8:
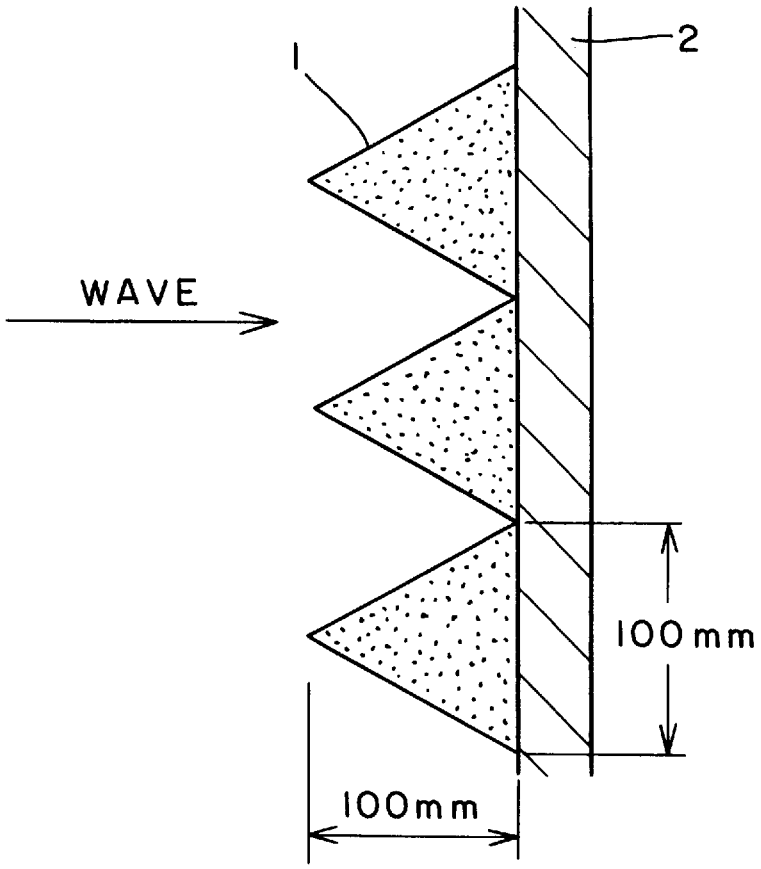
FIG. 8 is a cross section showing the structure of an embodiment of a wave absorber according to the present invention.

An Ni—Zn ferrite with these amounts of CoO added formed a porous body of 60% porosity serving as the base material, and as shown in FIG. 8, formed a wave absorber 1 having a pyramid shape the area of whose lower surface (base) was 100 mm×100 mm and whose height was 100 mm, this being attached without a gap therebetween to one surface of a reflection plate 2, then waves were made incident perpendicularly to the surface of the reflection plate 2 and the absorption factor thereof was measured. The results are shown in FIG. 7. In this figure is shown a graph of wave absorption characteristics in the cases of four types where the added amount of CoO is 0, 5, 25, and 40 weight percent, the abscissa being the frequency and the ordinate being the wave absorption factor.

As is clear from this graph, the 20 dB absorption range was wide at 1 GHz to 30 GHz where the added amount of CoO was 5 to 40 weight percent, exhibiting an excellent wave absorption characteristic. Where the added amount of CoO was under 5 weight percent, this characteristic was insufficient at the high frequency end, and where the added amount was over 40 weight percent, this characteristic was unacceptable at the low frequency end.

Fourth Embodiment

Figure 9:
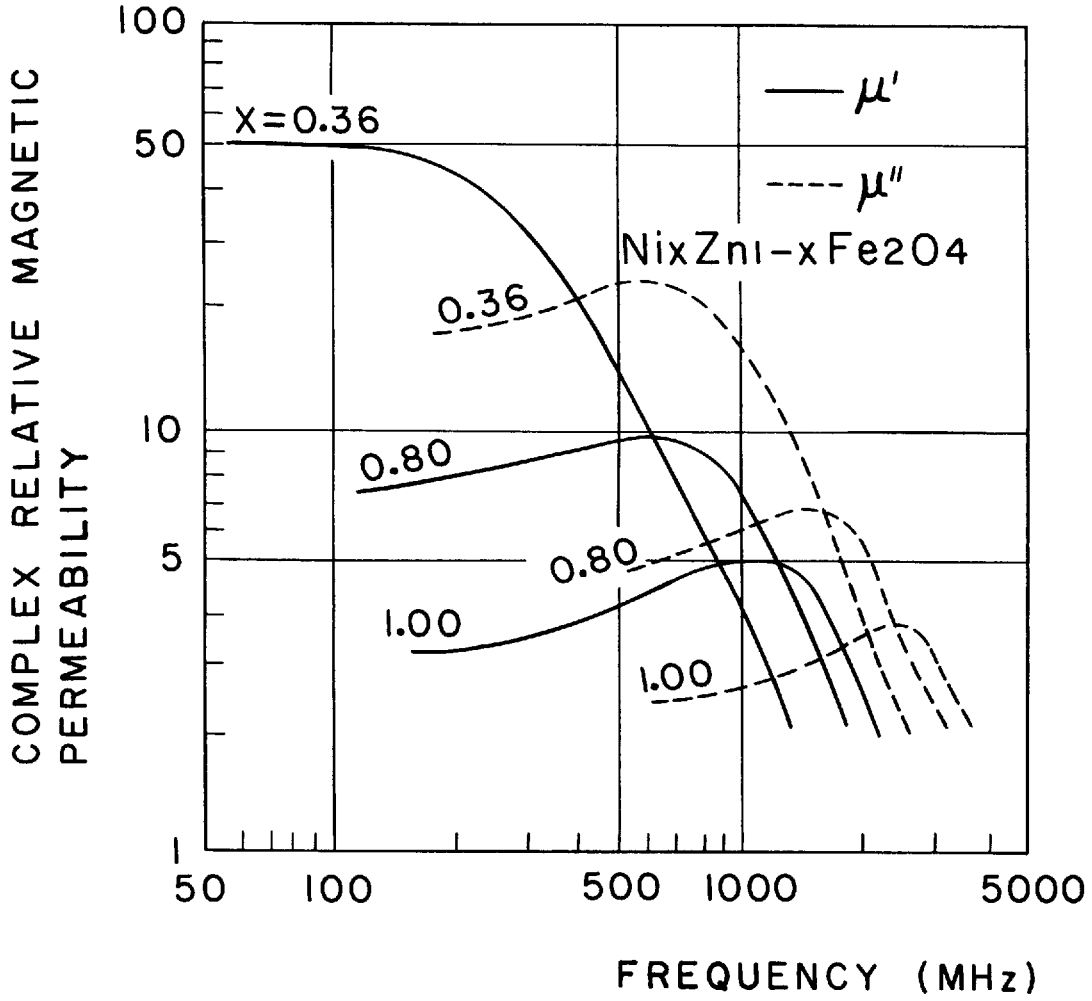
FIG. 9 is a graph showing the complex relative magnetic permeability frequency characteristics of an Ni—Zn type ferrite of various Ni ratios to which 5 weight % of CoO has been added.
Figure 10:
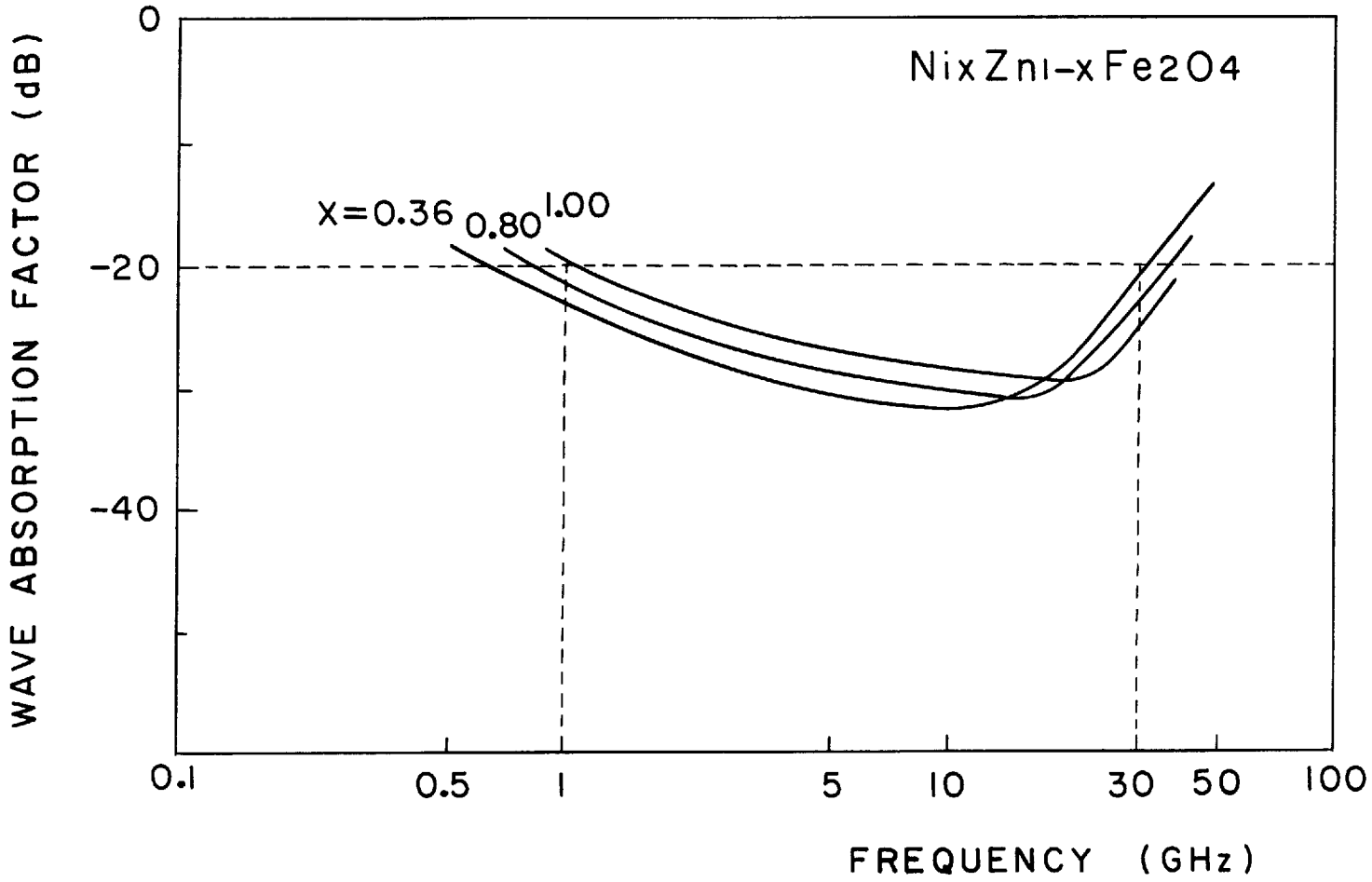
FIG. 10 is a graph showing the wave absorption characteristics of an Ni—Zn type ferrite porous body of various Ni ratios to which 5 weight % of CoO has been added.

The frequency characteristics of magnetic permeability of three types of base material, to all of which 5 weight percent of CoO had been added and in which the Ni ratios X of a $Ni_XZn_{1-X}Fe_2O_4$ ferrite were 0.36, 0.80 and 1.00, are shown in FIG. 9 with the abscissa being the frequency and the ordinate being the complex relative magnetic permeability. An Ni—Zn ferrite with these Ni ratios and 5 weight percent of CoO added formed a porous body of 60% porosity serving as the base material, and as shown in FIG. 8, formed a wave absorber 1 having a pyramid shape the area of whose lower surface (base) was 100 mm×100 mm and whose height was 100 mm, this being attached to a reflection plate 2, then waves were made perpendicularly incident to the surface of the reflection plate 2 and the absorption factor thereof was measured. A graph of these wave absorption characteristics are shown in FIG. 10 with the abscissa being the frequency and the ordinate being the wave absorption factor. As is clear from this graph, the 20 dB absorption range was wide at 1 GHz to 30 GHz where the Ni ratio was 0.36 or more. Incidentally, where CoO was not added, the 20 dB absorption range of a wave absorber where the Ni ratio was similarly 0.36 to 1.00 and which was formed in the same shape was 1 GHz to 20 GHz, the characteristic in the high frequency range improving remarkably when CoO was added.

Fifth Embodiment

Figure 11:
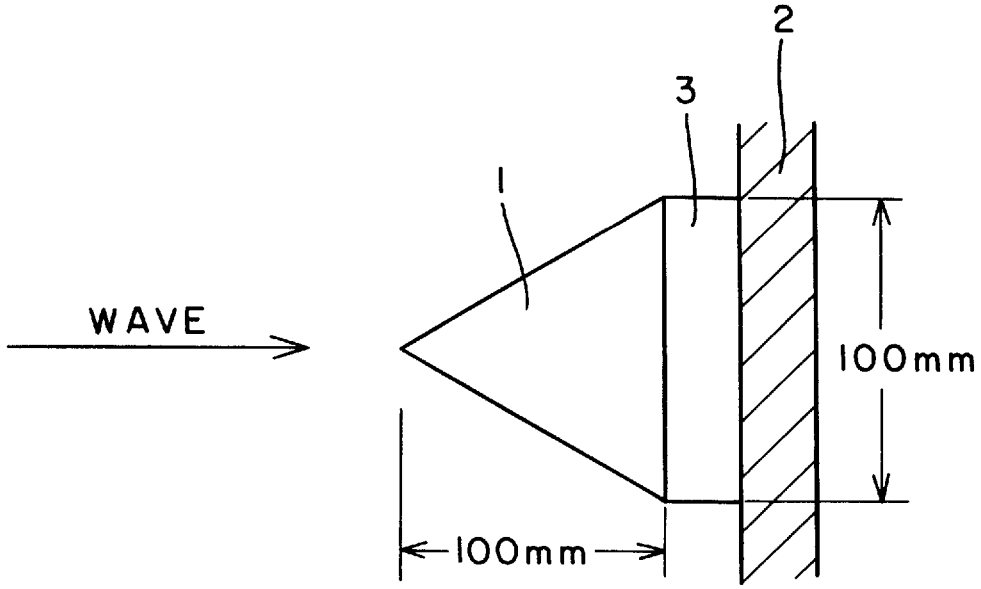
FIG. 11 is a cross section showing the structure of another embodiment of a wave absorber according to the present invention.
Figure 12:
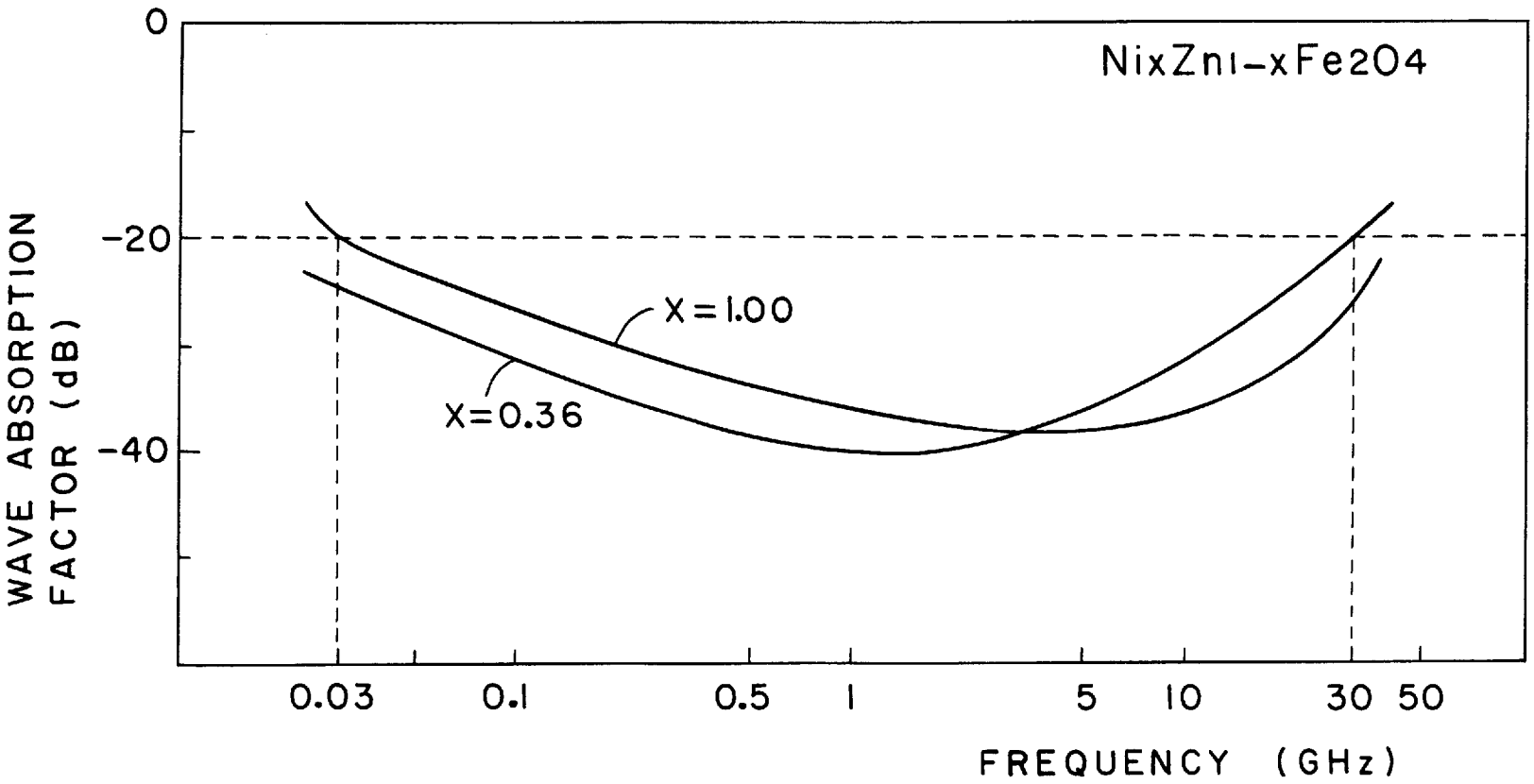
FIG. 12 is a graph showing the wave absorption characteristics of a structure combining an Ni—Zn type ferrite porous body to which CoO has been added and a ferrite tile.

The pyramid-shaped porous body of the third embodiment formed of Ni—Zn ferrite (Ni ratio 0.36) to which 5 weight percent of CoO was added and the pyramid-shaped porous body of the fourth embodiment formed of Ni—Zn ferrite whose Ni ratio was 1.00 and to which 5 weight percent of CoO was added were combined with a ferrite tile 3 as shown in FIG. 11, and the wave absorption factors of each were measured. A graph of the absorption characteristics thereof is shown in FIG. 12, the abscissa being the frequency and the ordinate being the wave absorption factor. As is clear from this graph, the 20 dB absorption range was wide at 30 MHz to 30 GHz, the absorption characteristic improving remarkably in the low frequency range under 1 GHz due to the combination with ferrite tile.

As described above, according to the present invention, a wave absorber which has a 20 dB wave absorption characteristic in the high frequency range of 1 GHz to 30 GHz, and is excellent in terms of fire resistance, compactness and lightness can be achieved, and a dark room corresponding to high frequency bands can be economically constructed.

Sixth Embodiment

Figure 13:
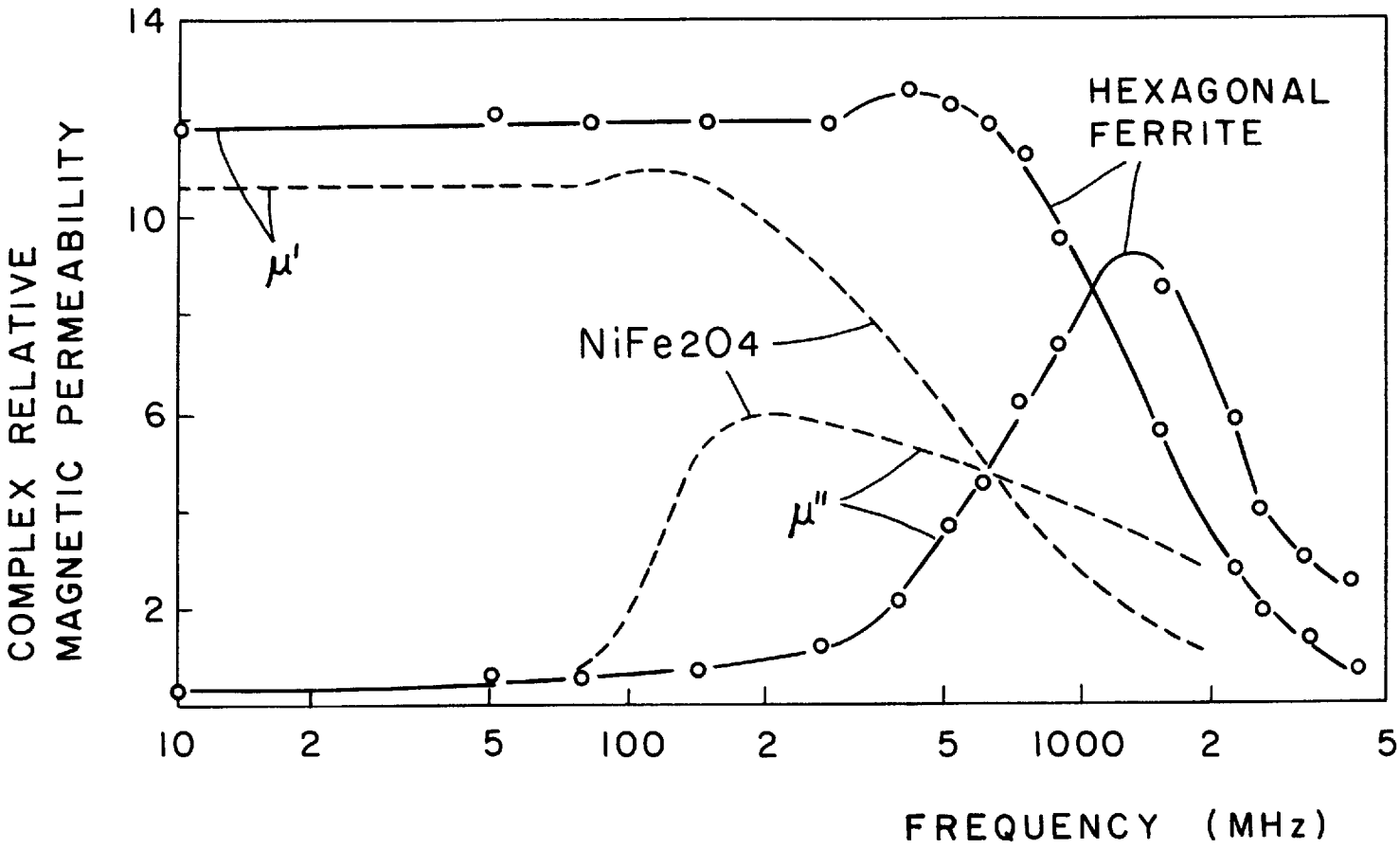
FIG. 13 is a graph comparing the complex relative magnetic permeability frequency characteristics of a hexagonal ferrite and the frequency characteristics of an Ni ferrite.
Figure 14:
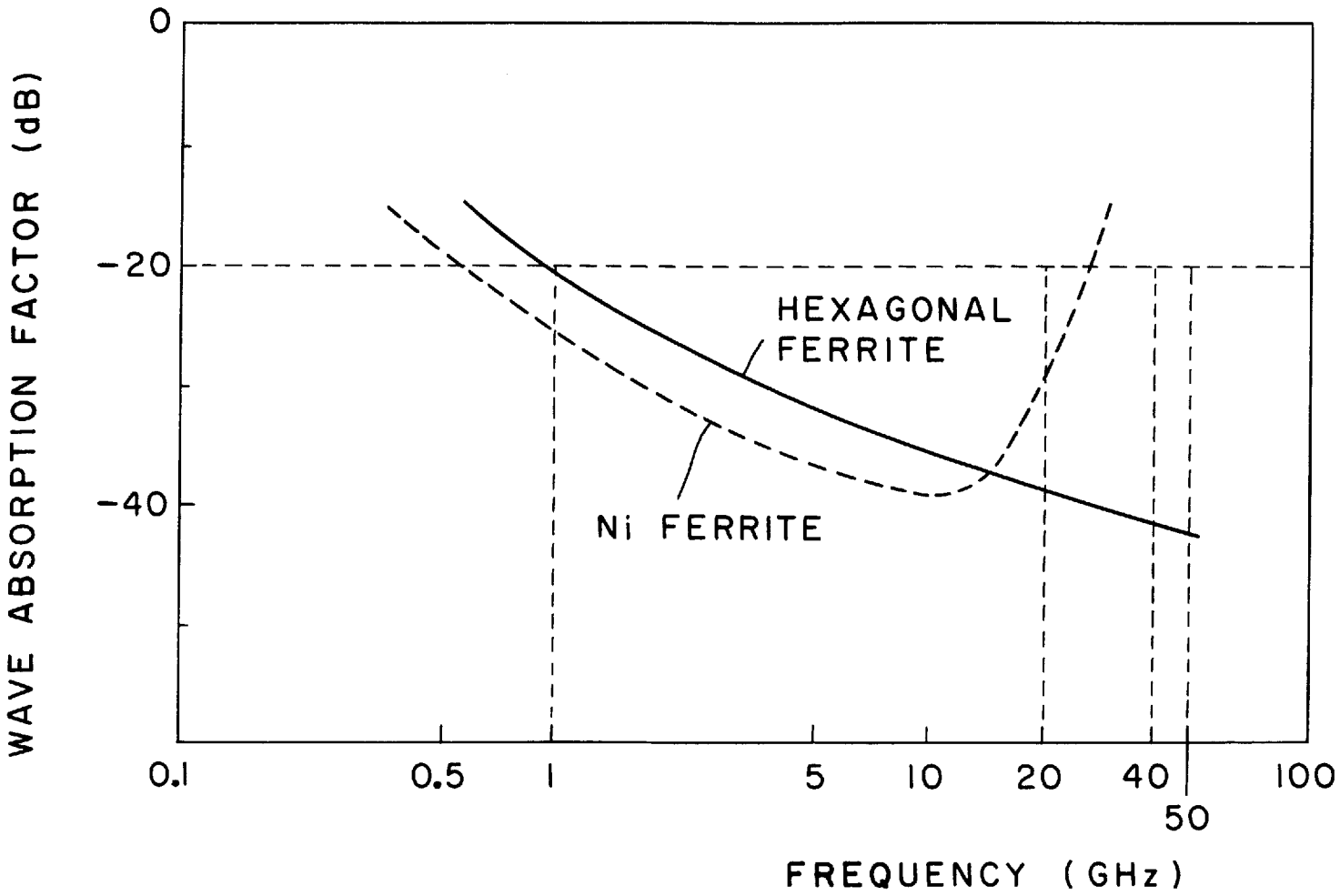
FIG. 14 is a graph comparing the wave absorption characteristics of a hexagonal ferrite and an Ni ferrite porous body.
Figure 15:
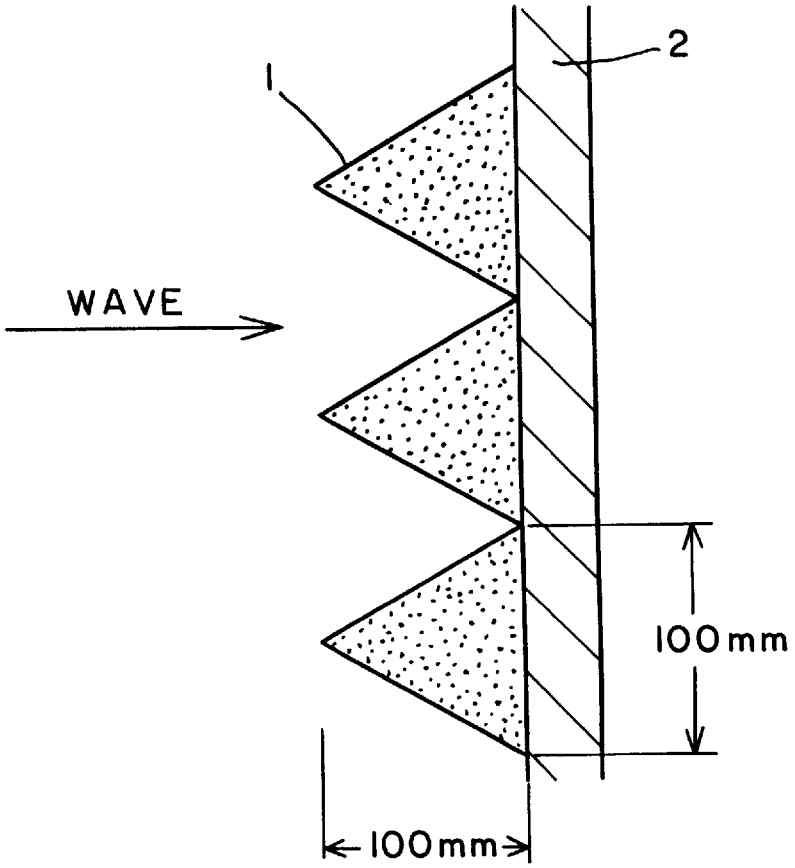
FIG. 15 is a cross section showing the structure of an embodiment of the present invention.

As already described in conjunction with FIG. 13, the wave absorption characteristic of a hexagonal ferrite had a still higher frequency characteristic than the Ni ferrite having the highest frequency characteristic among the Ni—Zn ferrite compositions which are excellent as wave absorbing materials. A porous body of 60% porosity with the hexagonal ferrite and Ni ferrite serving as the base materials was formed into a wave absorber 1 having a pyramid shape the area of whose lower surface (base) was 100 mm×100 mm and whose height was 100 mm as shown in FIG. 15, this was attached to one surface of a reflection plate 2 without a gap therebetween, then waves were made perpendicularly incident to the surface of the reflection plate 2 and the absorption factors thereof were measured. A wave absorption characteristic graph based on the measurement results is shown in FIG. 14. In this graph, the wave absorption characteristic curve with respect to the hexagonal ferrite is indicated by the solid line and that with respect to the Ni ferrite is indicated by the broken line, while the abscissa is frequency and the ordinate is wave absorption factor. As is clear from this graph, compared with the 20 dB absorption range of 1 to 20 GHz of the pyramidal porous body of Ni ferrite, the 20 dB absorption range of the pyramidal porous body of hexagonal ferrite was extremely wide at 1 Ghz to 40 GHz.

Seventh Embodiment

Figure 16:
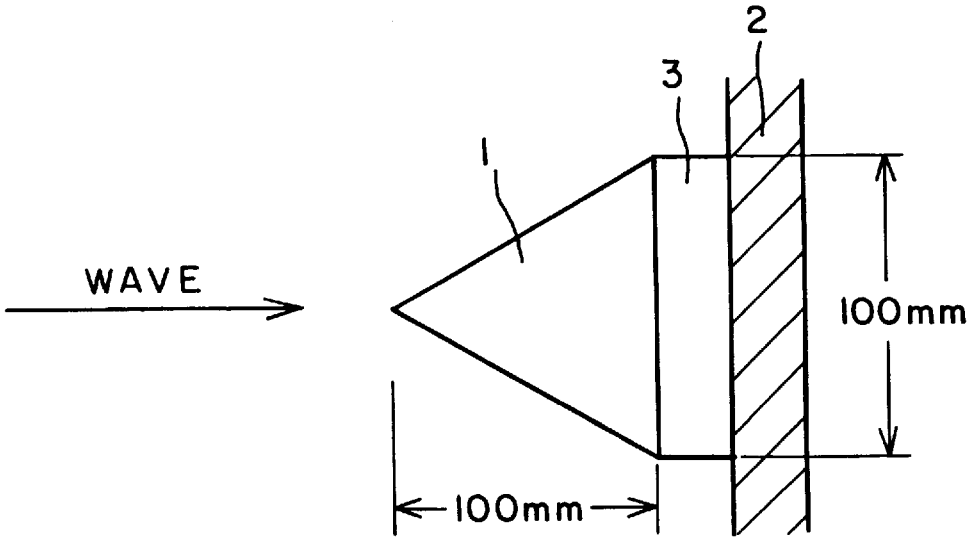
FIG. 16 is a cross section showing the structure of another embodiment of the present invention.
Figure 17:
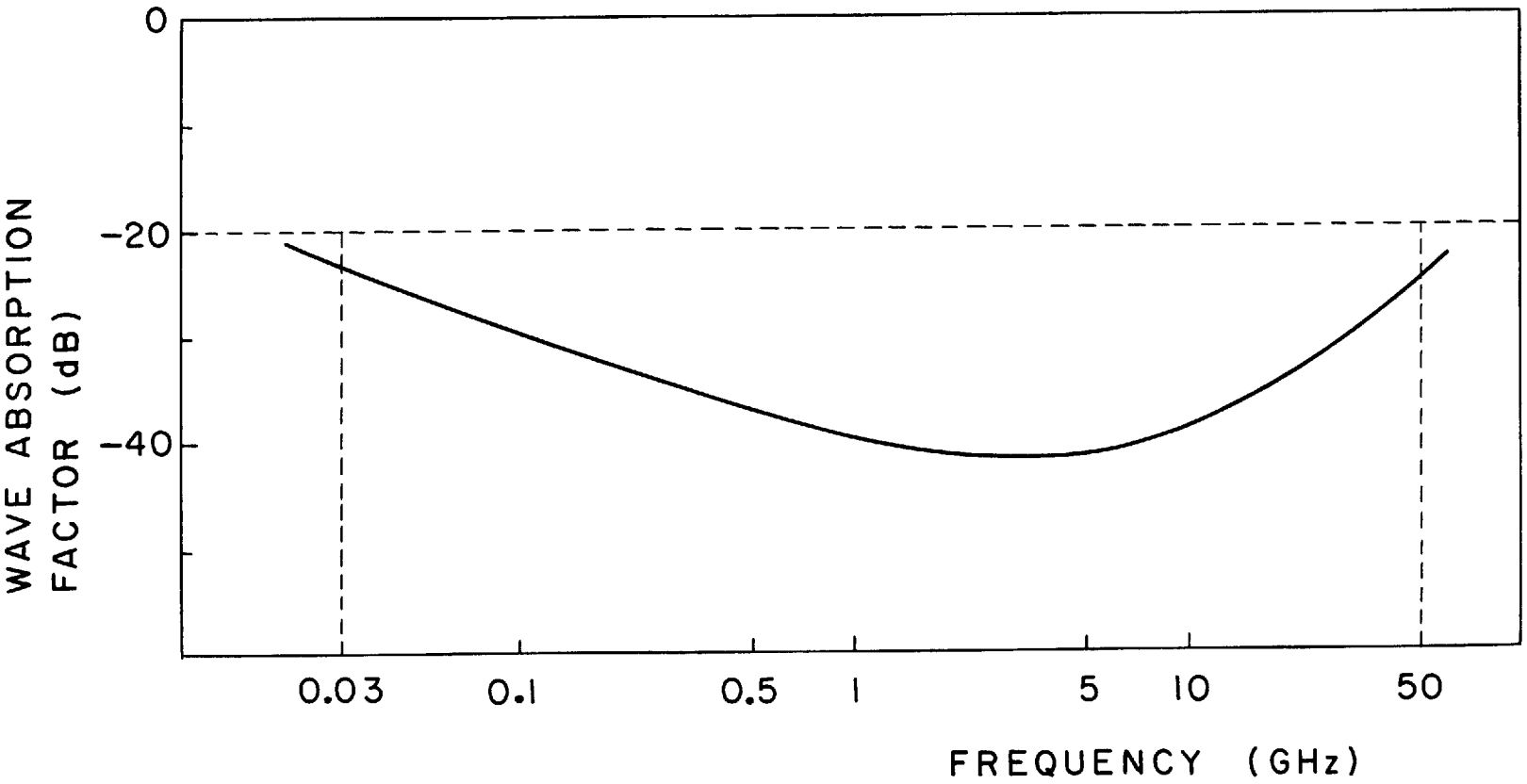
FIG. 17 is a graph showing wave absorption characteristics of the wave absorber of the structure shown in FIG. 16.
Figure 18:
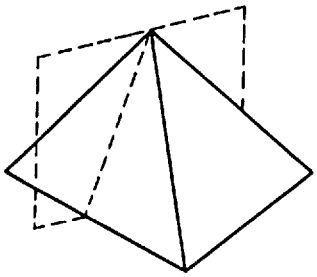
FIGS. 18 and 18(a)–18(c) show the hollow shape of a hollow pyramid type porous ferrite according to the present invention, sectioned through the plane indicated by the dotted line.
Figure 18A:
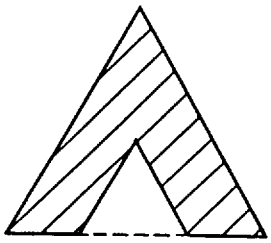
Figure 18B:
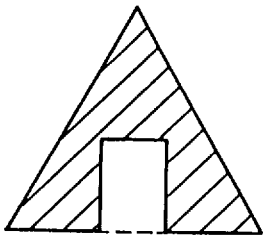
Figure 18C:
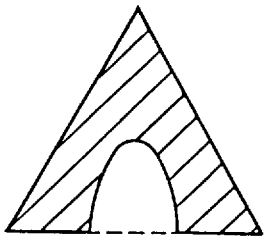

The pyramidal porous body 1 of hexagonal ferrite of the sixth embodiment was, as shown in FIG. 16, combined with a ferrite tile 3 and attached to one surface of a reflection plate 2, then waves were made incident perpendicularly to the surface thereof to measure the wave absorption factor thereof. A wave absorption characteristic graph based on the measurement results is shown in FIG. 17. As is clear from this graph, by combining the pyramidal porous body 1 of hexagonal ferrite with a ferrite tile 3, the absorption characteristic at low frequencies of less than 1 GHz was improved, and the 20 dB absorption range was wide at 30 MHz to 50 GHz.

As described above, according to the present invention, a wave absorber which has a 20 dB wave absorption characteristic in the high frequency range of 1 GHz to 50 GHz, and is excellent in terms of fire resistance, compactness and lightness can be achieved.

Further, in the case of a hollow structure, although there was a tendency towards deterioration of the wave absorption characteristic, generally the necessary characteristic for a wave absorber is the absorption factor at 20 dB upward. The absorption range at 20 dB upward of a pyramidal porous body whose height is 100 m or more was in the order of 1 GHz to 40 GHz, but where it had a hollow configuration, it exhibited the same characteristic at a height of over 20 mm.

The hollow configuration, if the thickness of the porous ferrite is constant, can be used in various different shapes such as the pyramid shape, rectangular prism and semicircular shape shown in FIGS. 18 and 18(a)–18(c). During forming, in order for the hollow portion to be a cutting die, the rounded hollow shape is effective in releasing the mold.

TABLE 1

| COMPOSITION | POROUS FERRITE $Fe_2O_3$:Ni:Zn = 49.37:18.54:32.09 | FERRITE TILE SAME AS AT LEFT |
|---|---|---|
| SPECIFIC GRAVITY (g/cc) | 1.95 | 5.1 |

Where the apex portion of the pyramidal wave absorber was made flat, although the wave absorption characteristic had a tendency toward deterioration, generally the required characteristic for a wave absorber is the absorption factor at 20 dB or more. The absorption range at more than 20 dB of a pyramidal porous body whose height is 100 m or more was in the order of 1 GHz to 40 GHz, but where 20 mm or less of the apex portion was removed this shape could still satisfy the same characteristics. Also, the absorption range at 20 dB upward of a pyramid configuration porous ferrite whose thickness was 80 mm was 2 GHz to 30 GHz and even though this was the same thickness, the absorption characteristic of the configuration of the present invention was more favorable.

The shape of the apex portion can be a flat shape, rounded shape or any other type of shape as shown in FIGS 24(a) and 24(b), and these are very easy to extract since there is no concern over whether the apex portion has broken off, etc. during forming and application. Further, as shown in FIG. 25, the wave absorption characteristic does not deteriorate if edges other than the apex are rounded, and this shape aids mold separation.

The porous ferrite according to the present invention, because it has a hollow structure, is light weight, and this is effective during application. Also, the hollowed portion allows reduction in the amount of basic materials, and because it has the shape where the apex has been removed, there is no possibility of the apex being broken off such as in the prior art, and the ferrite of the present invention is lighter, more compact and more cost-effective than the configuration of the prior art.

Further, by suitably combining the porous ferrite with a ferrite tile so that there is no deterioration in the wave absorption characteristic of either, a nonflammable wave absorber can be achieved (waves can be effectively absorbed by the ferrite tile at the low frequency end and by the porous ferrite at the high frequency end).

Eighth Embodiment

With a ferrite having the characteristics shown in Table 2 as the base material, a pyramidal porous ferrite whose base was 100 mm by 100 mm and whose height was 100 mm (FIG. 19) and pyramidal porous ferrites having a hollow pyramid shaped structure (FIG. 20(a), 20(b) and 20(c): (1) base 60 mm×60 mm, height 60 mm, (2) base 70 mm×70 mm, height 70 mm, (3) base 80 mm×80 mm, height 80 mm) were formed, the wave absorption characteristics thereof in each frequency band were measured, and the results are shown in FIG. 21.

Although where it was a hollow structure its wave absorption characteristic deteriorated in the high frequency range, up till (1) and (2) its 20 dB or less absorption characteristic was satisfactory. With (3) the absorption characteristic deteriorated greatly and it could not maintain the 20 dB or less characteristic.

Ninth Embodiment

Hollow structure ((2)) pyramidal porous body of the eighth embodiment was combined with a ferrite tile as shown in FIG. 22 and the absorption factor thereof measured. The absorption characteristics thereof are shown in FIG. 23. By means of the ferrite tile, the absorption characteristic in the low frequency range of less than 1 GHz was improved, the 20 dB absorption range being 30 MHz to 40 Ghz.

Tenth Embodiment

With a ferrite having the characteristics shown in Table 2 as the base material, a pyramidal porous ferrite whose base was 100 mm by 100 mm and whose height was 100 mm (FIG. 19) and a pyramidal porous ferrite having 10 to 30 mm of its apex portion removed (FIG. 26) were formed, the wave absorption characteristics thereof at each frequency were measured, and the results are shown in FIG. 27.

Up till where the amount removed was 10 mm the pyramidal porous ferrite of the present invention exhibited a wave absorption characteristic which did not differ greatly from the prior art. Although upon removing more than this amount the wave absorption characteristic in the high frequency range deteriorated, it was still an under 20 dB absorption characteristic up till 20 mm was removed. When the removed amount reached 30 mm the absorption characteristic deteriorated greatly and the under 20 dB characteristic could not be maintained.

Eleventh Embodiment

By means of the same materials, a pyramidal porous ferrite whose base was 100 mm by 100 mm and whose height was 100 mm and a pyramidal porous ferrite having 20 mm of its apex portion removed as well as a pyramidal porous ferrite whose base was 100 mm by 100 mm and whose height as 80 mm were formed, the wave absorption characteristics thereof at each frequency were measured, and the results are shown in FIG. 28.

In contrast with the pyramidal porous ferrite whose base was 100 mm by 100 mm and whose height was 100 mm and the pyramidal porous ferrite having 20 mm of its apex portion removed which both exhibited over 20 dB absorption characteristics of 1 GHz to 40 GHz and up, the over 20 dB absorption characteristic of the 80 mm high pyramidal porous ferrite was 3 GHz to 30 GHz, the pyramidal porous ferrite with 20 mm of its apex portion removed having a better characteristic even though it was similarly 80 mm high.

Twelfth Embodiment

The pyramidal porous ferrite with 20 mm of its apex portion removed of the eleventh embodiment was combined with a ferrite tile as shown in FIG. 29 and the absorption factor thereof measured. The absorption characteristic thereof is shown in FIG. 30. By means of the ferrite tile, the absorption characteristic in the low frequency range of less than 1 GHz was improved, the 20 dB absorption range being 30 MHz to 40 Ghz.

By means of the present invention, as well as being able to obtain a wave absorber which is light and easy to handle by processing it in a pyramid shape or a wedge shape, the porous ferrite and ferrite tile thereof are suitably combined without deterioration of the wave absorption characteristic of either, whereby a favorable wave absorber which is nonflammable, durable and lightweight.

In the porous ferrite wave absorber of the present invention, as the height from the square base is increased the wave absorption characteristic in the lower frequency range improves. As shown in FIG. 31(a) and 31(b), in the prior art pyramid shape, it is difficult to overlap individual porous ferrites, making them difficult to install. In contrast to this, because the base is square, they are easy to overlap and easy to install.

Also, although the porous ferrite has an absorption range of 1 GHz to 40 GHz at 20 dB and over at a thickness of 100 mm, where the thickness of square portion of the base is 10 to 30 mm the absorption range at 20 dB and over is 500 MHz to 40 GHz, improving the absorption characteristic in the lower frequencies.

The porous ferrite has ferrite particles as its main component, soda silicate and soda aluminate are added thereto, and these are mixed by stirring them in the presence of a surface active agent, foaming agent and water, then a porous hydrogel formed in the desired shape is obtained by drying and sintering and this can be readily manufactured by the method of a patent application proposed and filed by the inventors of the present invention (Japanese Patent Application No. H5-72867).

The porous ferrite wave absorber obtained by this manufacturing method has an independent foaming rate of 80%, porosity in the range of 40 to 80% and pore diameter in the range of 100 to 800 $\mu$m, each of these being uniformly controllable.

Also, as shown in FIG. 32, by combining individual porous ferrites of this shape to form them into a panel form is effective during application. Further, as shown in FIG. 33, if each of the edges is rounded, mold separation is easy so that this is also effective with respect to forming.

Moreover, by suitably combining the porous ferrite with a ferrite tile so that there is no deterioration in the wave absorption characteristic of either, a nonflammable wave absorber can be achieved (waves can be effectively absorbed by the ferrite tile at the low frequency end and by the porous ferrite at the high frequency end).

Thirteenth Embodiment

With a ferrite having the characteristics shown in Table 2 as the base material, a pyramidal porous ferrite whose base was 100 mm by 100 mm and whose height was 100 mm (FIG. 34) and a pyramidal porous ferrite which is the porous ferrite of the present invention formed in a pyramid on a rectangular parallelepiped with the depth from the lower surface of the rectangular parallelepiped being 10 to 30 mm (FIG. 35(a)–35(c)) were formed, the wave absorption characteristics thereof at each frequency were measured, and the results are shown in FIG. 36.

As the thickness of the lower surface of the rectangular parallelepiped becomes larger, the wave absorption characteristic at lower frequencies improves while the wave absorption characteristic at higher frequencies does not change.

TABLE 2

| COMPOSITION | POROUS FERRITE $Fe_2O_3$:Ni:Zn 49.37:18.54:32.09 | = | FERRITE TILE SAME AS AT LEFT |
|---|---|---|---|
| SFECIFIC GRAVITY (g/cc) | 1.95 | | 5.1 |

Fourteenth Embodiment

The pyramidal porous ferrite according to the present invention (depth from lower surface of rectangular parallelepiped 20 mm) acquired by means of the thirteenth embodiment was combined with a ferrite tile as shown in FIG. 37 and the absorption factor thereof measured. The absorption characteristic thereof is shown in FIG. 38. By means of the ferrite tile, the absorption characteristic in the low frequency range of less than 1 GHz was improved, the 20 dB absorption range being 30 MHz to 40 Ghz.

The porous ferrite wave absorber of the present invention, by suitably changing the thickness from the lower surface of the rectangular parallelepiped portion, can improve the absorption characteristic in the low frequency range without changing the absorption characteristic in the high frequency range, and in addition by using this porous ferrite in combination with a ferrite tile, is applicable as a wide frequency range wave absorber, having excellent lightness, compactness, durability and workability.

As many apparently widely different embodiments of the present invention can be made without departing from the sprit and scope thereof, it is to be understood that the invention is not limited to the specific embodiments thereof except as defined in the appended claims.

What is claimed is:

1. A wave absorber comprising a pyramid shaped hollow body of a porous ferrite material having a porosity of from 30% to 90%, said ferrite being formed from a compound of the formula $Ni_xZn_{1-x}Fe_2O_4$, where x=0.36 to 1.00, and which has a pyramid shaped hollow portion and absorbs waves of 20 dB or more in a 1 GHz to 20 GHz frequency band.

2. A wave absorber of claim 1, a tip thereof being trimmed to a plane shape or a rounded shape.

3. A wave absorber characterized by being a combination of the wave absorber of claim 1 and a ferrite tile.

4. A wave absorber of claim 1, wherein the porous ferrite material is formed from a compound of the formula $Ni_xZn_{1-x}Fe_2O_4$, where x=0.5 to 0.8, and has a porosity of 60% to 80%.

* * * * *